US009759461B2

(12) United States Patent
Numata et al.

(10) Patent No.: US 9,759,461 B2
(45) Date of Patent: Sep. 12, 2017

(54) HEAT EXCHANGER

(71) Applicant: DAIKIN APPLIED AMERICAS INC., Minneapolis, MN (US)

(72) Inventors: Mitsuharu Numata, Plymouth, MN (US); Kazushige Kasai, Minnetonka, MN (US)

(73) Assignee: DAIKIN APPLIED AMERICAS INC., Minneapolis, MN (US)

( * ) Notice: Subject to any disclaimer, the term of this patent is extended or adjusted under 35 U.S.C. 154(b) by 263 days.

(21) Appl. No.: 13/974,439

(22) Filed: Aug. 23, 2013

(65) Prior Publication Data

US 2015/0053378 A1 Feb. 26, 2015

(51) Int. Cl.
*F28D 5/02* (2006.01)
*B01D 5/00* (2006.01)
(Continued)

(52) U.S. Cl.
CPC ..... *F25B 39/028* (2013.01); *F28D 5/02* (2013.01); *F28D 7/16* (2013.01); *F28D 7/163* (2013.01);
(Continued)

(58) Field of Classification Search
CPC ..... F25B 39/02; F25B 39/028; F28D 5/02; F28D 3/02; F28D 3/04; F28D 7/16;
(Continued)

(56) References Cited

U.S. PATENT DOCUMENTS 176,472 A * 4/1876 Hoppenrath ..... A61G 7/05 5/110
320,144 A * 6/1885 Kux ..... F25B 43/046 165/116
(Continued)

FOREIGN PATENT DOCUMENTS

JP 43-10680 U 5/1968
WO 2013074749 A1 5/2013

OTHER PUBLICATIONS

International Preliminary Report on Patentability for the corresponding international application No. PCT/US2014/051337 issued on Feb. 23, 2016.
(Continued)

*Primary Examiner* — Grant Moubry
*Assistant Examiner* — Jason Thompson
(74) *Attorney, Agent, or Firm* — Global IP Counselors, LLP

(57) ABSTRACT

A heat exchanger for a vapor compression system includes a shell, a distributing part disposed inside of the shell to distribute a refrigerant, a tube bundle and a trough part. The tube bundle includes a plurality of heat transfer tubes disposed inside of the shell below the distributing part. The tube bundle includes a falling film region disposed below the distributing part, an accumulating region disposed below the falling film region, and a flooded region disposed below the accumulating region at a bottom portion of the shell. The trough part extends under at least one of the heat transfer tubes in the accumulating region to accumulate the refrig-
(Continued)

erant therein. The trough part at least partially overlaps with the at least one of the heat transfer tubes in the accumulating region when viewed along a horizontal direction perpendicular to the longitudinal center axis of the shell.

21 Claims, 32 Drawing Sheets

(51) Int. Cl.
*F28D 3/00* (2006.01)
*F25B 39/02* (2006.01)
*F28D 7/16* (2006.01)
*F28D 21/00* (2006.01)

(52) U.S. Cl.
CPC *F25B 2339/024* (2013.01); *F28D 2021/0064* (2013.01); *F28D 2021/0071* (2013.01)

(58) Field of Classification Search
CPC ... B01D 1/04; F28F 25/02; F28F 25/04; F28F 25/08; F28F 2025/005; F28F 25/082; F28F 25/085
USPC ..... 62/252, 527, 515, 471; 165/115, 116, 165/117; 122/39, 31.1, 31.2
See application file for complete search history.

(56) References Cited

U.S. PATENT DOCUMENTS 986,118 A * 3/1911 Alexander ..... F26B 17/023 159/15
1,577,477 A * 3/1926 Mallory ..... F01P 3/22 123/41.22
2,012,183 A * 8/1935 Carrier ..... F25B 39/02 62/394
2,038,022 A * 4/1936 Zubli ..... B44F 1/06 273/157 A
2,247,107 A * 6/1941 Waterfill ..... F25B 39/02 165/145
2,416,760 A * 3/1947 Bahler ..... C07C 2/54 165/109.1
4,226,283 A * 10/1980 Furukawa ..... F22D 1/32 122/441
4,389,226 A * 6/1983 Moller ..... B01D 3/16 126/378.1
5,561,987 A 10/1996 Hartfield et al.
5,839,294 A 11/1998 Chiang et al.
6,170,286 B1 1/2001 Keuper
6,233,967 B1 5/2001 Seewald et al.
6,293,112 B1 * 9/2001 Moeykens ..... F25B 39/02 165/115
6,868,695 B1 * 3/2005 Dingel ..... F25B 39/028 165/115
7,849,710 B2 12/2010 De Larminat et al.
8,302,426 B2 * 11/2012 de Larminat ..... F25B 39/028 62/515
2006/0080998 A1 * 4/2006 De Larminat ..... F25B 39/028 62/515
2008/0148767 A1 * 6/2008 De Larminat ..... F25B 39/028 62/498
2008/0149311 A1 * 6/2008 Liu ..... F25B 39/028 165/115
2008/0163637 A1 * 7/2008 Ring ..... F25B 39/028 62/304
2011/0017432 A1 * 1/2011 Kulankara ..... F28D 3/02 165/115

OTHER PUBLICATIONS

Office Action for the corresponding Chinese application No. 201480046557.7, dated May 15, 2017.

* cited by examiner

HEAT EXCHANGER

BACKGROUND OF THE INVENTION

Field of the Invention

This invention generally relates to a heat exchanger adapted to be used in a vapor compression system. More specifically, this invention relates to a heat exchanger including a tube bundle with a falling film region, an accumulating region and a flooded region.

Background Information

Vapor compression refrigeration has been the most commonly used method for air-conditioning of large buildings or the like. Conventional vapor compression refrigeration systems are typically provided with an evaporator, which is a heat exchanger that allows the refrigerant to evaporate from liquid to vapor while absorbing heat from liquid to be cooled passing through the evaporator. One type of evaporator includes a tube bundle having a plurality of horizontally extending heat transfer tubes through which the liquid to be cooled is circulated, and the tube bundle is housed inside a cylindrical shell. There are several known methods for evaporating the refrigerant in this type of evaporator. In a flooded evaporator, the shell is filled with liquid refrigerant and the heat transfer tubes are immersed in a pool of the liquid refrigerant so that the liquid refrigerant boils and/or evaporates as vapor. In a falling film evaporator, liquid refrigerant is deposited onto exterior surfaces of the heat transfer tubes from above so that a layer or a thin film of the liquid refrigerant is formed along the exterior surfaces of the heat transfer tubes. Heat from walls of the heat transfer tubes is transferred via convection and/or conduction through the liquid film to the vapor-liquid interface where part of the liquid refrigerant evaporates, and thus, heat is removed from the water flowing inside of the heat transfer tubes. The liquid refrigerant that does not evaporate falls vertically from the heat transfer tube at an upper position toward the heat transfer tube at a lower position by force of gravity. There is also a hybrid falling film evaporator, in which the liquid refrigerant is deposited on the exterior surfaces of some of the heat transfer tubes in the tube bundle and the other heat transfer tubes in the tube bundle are immersed in the liquid refrigerant that has been collected at the bottom portion of the shell.

Although the flooded evaporators exhibit high heat transfer performance, the flooded evaporators require a considerable amount of refrigerant because the heat transfer tubes are immersed in a pool of the liquid refrigerant. With recent development of new and high-cost refrigerant having a much lower global warming potential (such as R1234ze or R1234yf), it is desirable to reduce the refrigerant charge in the evaporator. The main advantage of the falling film evaporators is that the refrigerant charge can be reduced while ensuring good heat transfer performance. Therefore, the falling film evaporators have a significant potential to replace the flooded evaporators in large refrigeration systems.

U.S. Pat. No. 5,839,294 discloses a hybrid falling film evaporator that has a section that operates in a flooded mode and a section that operates in a falling film mode. More specifically, the evaporator disclosed in this publication includes an outer shell through which passes a plurality of horizontal heat transfer tubes in a tube bundle. A distribution system is provided in overlying relationship with the upper most level of the heat transfer tubes in the tube bundle so that refrigerant which enters into the shell is dispensed onto the top of the tubes. The liquid refrigerant forms a film along an exterior wall of each of the heat transfer tubes where part of the liquid refrigerant evaporates as the vapor refrigerant. The rest of the liquid refrigerant collects in the lower portion of the shell. In steady state operation, the level of liquid refrigerant within the outer shell is maintained at a level such that at least twenty-five percent of the horizontal heat transfer tubes near the lower end of the shell are immersed in liquid refrigerant. Therefore, in this publication, the evaporator operates with the heat transfer tubes in the lower section of the shell operating in a flooded heat transfer mode, while the heat transfer tubes which are not immersed in liquid refrigerant operate in a falling film heat transfer mode.

U.S. Pat. No. 7,849,710 discloses a falling film evaporator in which liquid refrigerant collected in a lower portion of an evaporator shell is recirculated. More specifically, the evaporator disclosed in this publication includes the shell having a tube bundle with a plurality of heat transfer tubes extending substantially horizontally in the shell. Liquid refrigerant that enters in the shell is directed from a distributor to the heat transfer tubes. The liquid refrigerant creates a film along an exterior wall of each of the heat transfer tubes where part of the liquid refrigerant evaporates as the vapor refrigerant. The rest of the liquid refrigerant collects in a lower portion of the shell. In this publication, a pump or an ejector is provided to draw the liquid refrigerant collected in the lower portion of the shell to recirculate the liquid refrigerant from the lower portion of the shell to the distributor.

SUMMARY OF THE INVENTION

The hybrid falling film evaporator disclosed in U.S. Pat. No. 5,839,294 as mentioned above still presents a problem that it requires a relatively large amount of refrigerant charge because of the existence of the flooded section at the bottom portion of the shell. On the other hand, with the evaporator disclosed in U.S. Pat. No. 7,849,710, which recirculates the collected liquid refrigerant from the bottom portion of the shell to the distributor, an excess amount of circulated refrigerant is required in order to rewet dry patches on the heat transfer tubes in case such dry patches are formed due to fluctuation in performance of the evaporator. Moreover, when a compressor in the vapor compression system utilizes lubrication oil (refrigerant oil), the oil migrated from the compressor into the refrigeration circuit of the vapor compression system tends to accumulate in the evaporator because the oil is less volatile than the refrigerant. Thus, with the refrigerant recirculation system as disclosed in U.S. Pat. No. 7,849,710, the oil is recirculated within the evaporator along with the liquid refrigerant, which causes a high concentration of the oil in the liquid refrigerant circulating in the evaporator. Therefore, performance of the evaporator is degraded.

With the conventional technique, an oil separator is provided behind a compressor to secure the performance of an evaporator in a refrigerating cycle in which a small amount of oil is flowed out from the compressor. In this system, the following methods have been employed: (1) Using a large oil separator and a flooded type; (2) Using a small oil separator and a hybrid falling film type. In (1), the cost of the large oil separator is high. In (2), the amount of the refrigerant can be reduced by the falling film type. However, since a lot of flooded sections are needed, the effect of reducing the refrigerant amount will be diminished. Also, a lot of heat transfer pipes are needed to condense oil.

In addition, a small amount of oil (normally 0.5-2 wt %) typically enters the evaporator in a system in which a small amount of oil is supplied in the refrigerant ejected from the compressor (for example, in a refrigerating cycle using a screw compressor). In the hybrid type heat exchanger (flooded type, falling film type) where the refrigerant evaporates on the outer surface of the heat transfer pipes provided within a shell in an evaporator for exchanging heat between cold water and refrigerant, oil is not contained in the refrigerant vapor evaporated within the heat exchanger. Accordingly, oil is condensed within the evaporator, and the oil concentration in the liquid refrigerant is increased (see FIG. 32).

Normally, an oil tempering circuit is installed to return the oil to the compressor in this cycle (see FIG. 33, U.S. Pat. No. 6,233,967). In this oil tempering, the oil is returned to the compressor together with the refrigerant. Since the oil is returned to the compressor together with the refrigerant, if the amount of the returned refrigerant is large, an invalid refrigerant is increased. Then, the performance will be deteriorated. Therefore, in order to prevent the performance from being deteriorated, the concentration of oil needs to be increased (the ratio of the refrigerant is made as small as possible).

When the concentration of oil flowing into the evaporator is 0.5 wt %, the concentration of oil to be returned to the compressor needs to be increased to 30 wt % in order to control the performance deterioration within 2% (the amount of the refrigerant used for oil tempering is within 2% of the evaporation amount) (see FIG. 34). Conventionally, in this system, a flooded type (FIG. 35) or a hybrid falling film type which has a falling film type upper section and a flooded type lower section (FIG. 36, U.S. Pat. No. 6,170,286) is employed.

In the case of the flooded type, the heat transfer performance is deteriorated as the concentration of oil increases as shown in FIG. 37. Therefore, the concentration of oil needs to be around 2 wt %. In such a case, the concentration of oil needs to be around 0.05 wt %, which requires a large gas-liquid separator.

In the hybrid falling film type, the concentration of oil is small and the performance is secured in the falling film type upper section. In the falling film type, when the concentration of oil is increased, the performance will be deteriorated greatly and condensation of oil to 30 wt % will be difficult. Therefore, condensation of oil is performed in the flooded type lower section. Then, a liquid refrigerant of high concentration of oil is returned from the flooded section to the compressor.

As described above, a method using a large oil separator and a flooded type or a method using a small oil separator and a hybrid falling film type is employed.

In the hybrid falling film type evaporator, the heat transfer performance of the flooded section is around half of the falling film type section. Therefore, a lot of heat transfer pipes are needed. Also, since a lot of flooded sections are needed, the amount of the refrigerant becomes large.

In view of the above, one object of the present invention is to provide a heat exchanger that can reduce the amount of refrigerant charge while ensuring good performance of the heat exchanger.

Another object of the present invention is to provide a heat exchanger that accumulates refrigerant oil migrated from a compressor into a refrigeration circuit of a vapor compression system and discharges the refrigerant oil outside of the evaporator.

A heat exchanger according to one aspect of the present invention is adapted to be used in a vapor compression system, and includes a shell, a distributing part, a tube bundle and a trough part. The shell has a longitudinal center axis extending generally parallel to a horizontal plane. The distributing part is disposed inside of the shell to distribute a refrigerant. The tube bundle includes a plurality of heat transfer tubes disposed inside of the shell below the distributing part so that the refrigerant discharged from the distributor is supplied onto the tube bundle. The heat transfer tubes extend generally parallel to the longitudinal center axis of the shell. The tube bundle includes a falling film region disposed below the distributing part, an accumulating region disposed below the falling film region, and a flooded region disposed below the accumulating region at a bottom portion of the shell. The trough part extends generally parallel to the longitudinal center axis of the shell under at least one of the heat transfer tubes in the accumulating region to accumulate the refrigerant therein. The trough part at least partially overlaps with the at least one of the heat transfer tubes in the accumulating region when viewed along a horizontal direction perpendicular to the longitudinal center axis of the shell.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
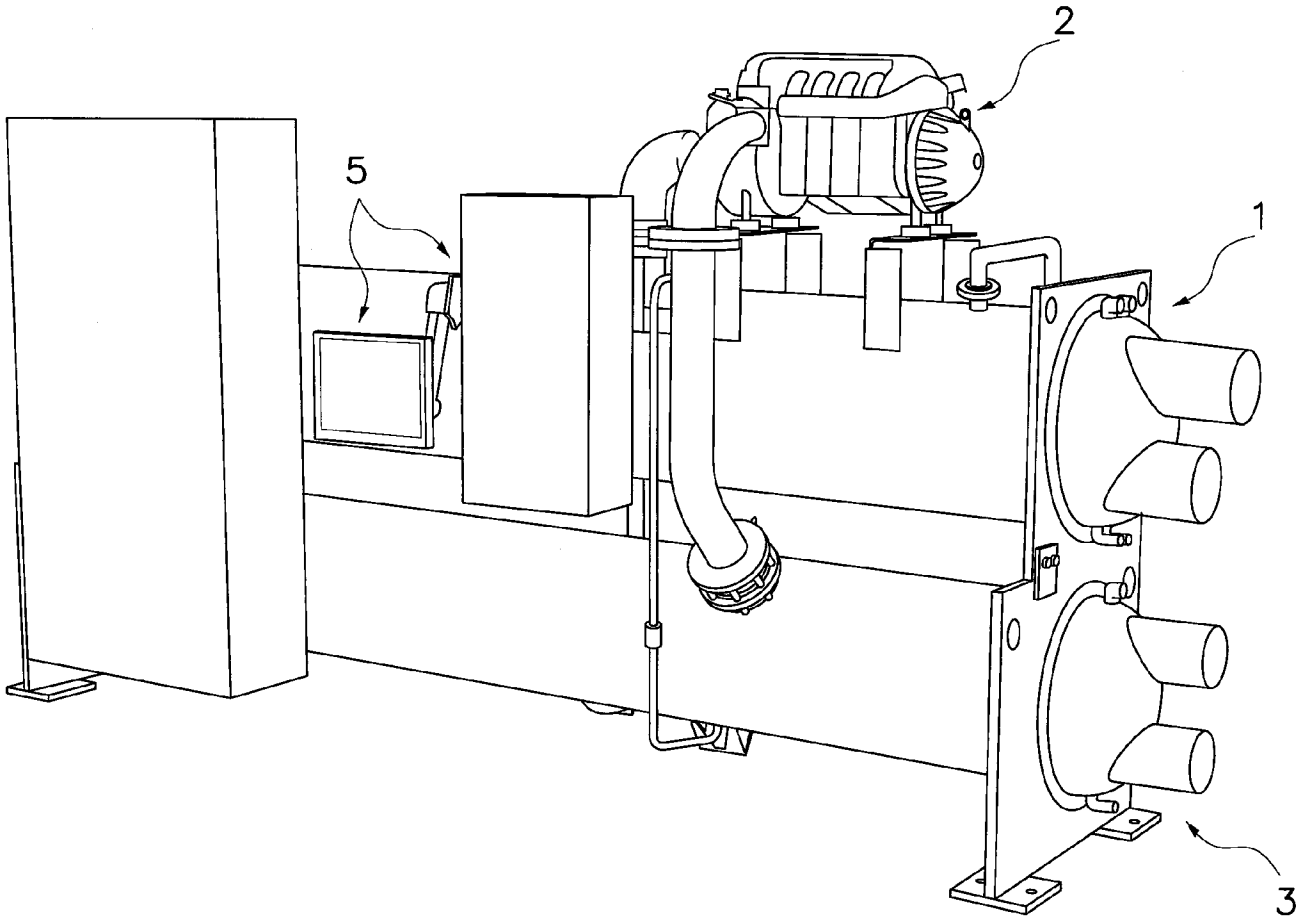
FIG. 1 is a simplified, overall perspective view of a vapor compression system including a heat exchanger according to a first embodiment of the present invention.
Figure 2:
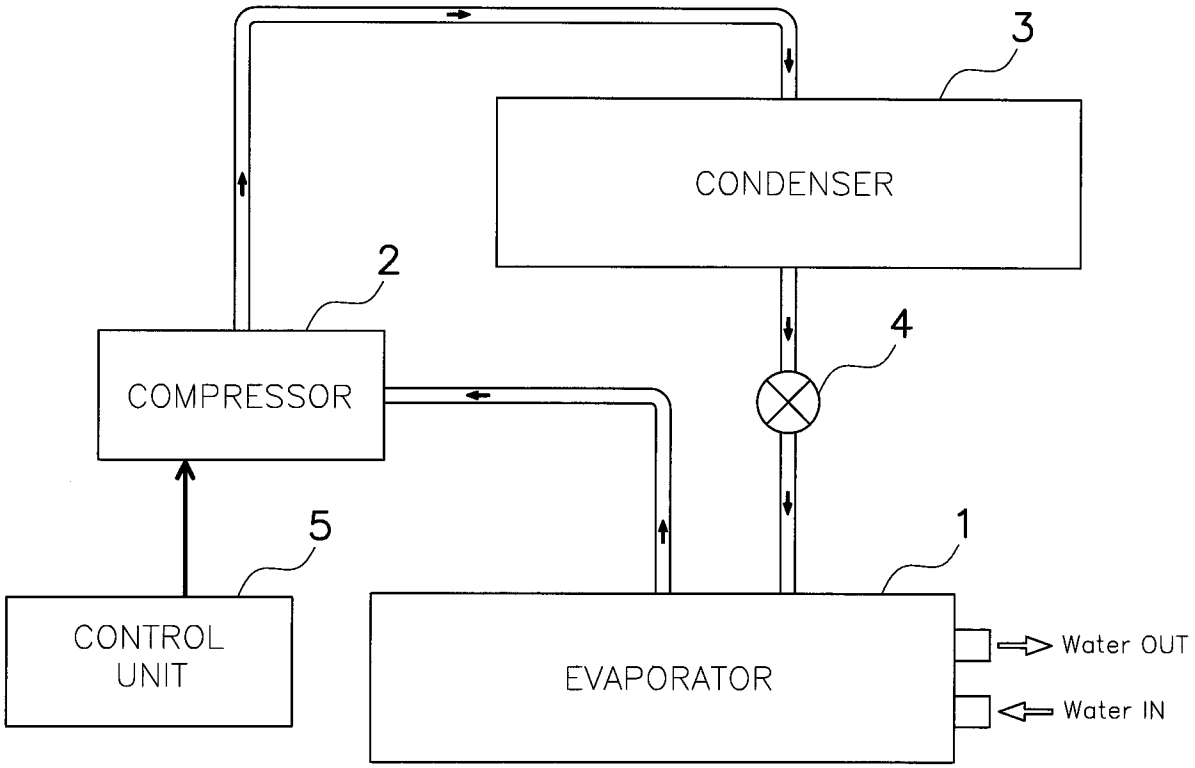
FIG. 2 is a block diagram illustrating a refrigeration circuit of the vapor compression system including the heat exchanger according to the first embodiment of the present invention.

Referring initially to FIGS. 1 and 2, a vapor compression system including a heat exchanger according to a first embodiment will be explained. As seen in FIG. 1, the vapor compression system according to the first embodiment is a chiller that may be used in a heating, ventilation and air conditioning (HVAC) system for air-conditioning of large buildings and the like. The vapor compression system of the first embodiment is configured and arranged to remove heat from liquid to be cooled (e.g., water, ethylene, ethylene glycol, calcium chloride brine, etc.) via a vapor-compression refrigeration cycle.

As shown in FIGS. 1 and 2, the vapor compression system includes the following four main components: an evaporator 1, a compressor 2, a condenser 3 and an expansion device 4.

The evaporator 1 is a heat exchanger that removes heat from the liquid to be cooled (in this example, water) passing through the evaporator 1 to lower the temperature of the water as a circulating refrigerant evaporates in the evaporator 1. The refrigerant entering the evaporator 1 is in a two-phase gas/liquid state. The liquid refrigerant evaporates as the vapor refrigerant in the evaporator 1 while absorbing heat from the water.

The low pressure, low temperature vapor refrigerant is discharged from the evaporator 1 and enters the compressor 2 by suction. In the compressor 2, the vapor refrigerant is compressed to the higher pressure, higher temperature vapor. The compressor 2 may be any type of conventional compressor, for example, centrifugal compressor, scroll compressor, reciprocating compressor, screw compressor, etc.

Next, the high temperature, high pressure vapor refrigerant enters the condenser 3, which is another heat exchanger that removes heat from the vapor refrigerant causing it to condense from a gas state to a liquid state. The condenser 3 may be an air-cooled type, a water-cooled type, or any suitable type of condenser. The heat raises the temperature of cooling water or air passing through the condenser 3, and the heat is rejected to outside of the system as being carried by the cooling water or air.

The condensed liquid refrigerant then enters through the expansion device 4 where the refrigerant undergoes an abrupt reduction in pressure. The expansion device 4 may be as simple as an orifice plate or as complicated as an electronic modulating thermal expansion valve. The abrupt pressure reduction results in partial evaporation of the liquid refrigerant, and thus, the refrigerant entering the evaporator 1 is in a two-phase gas/liquid state.

Some examples of refrigerants used in the vapor compression system are hydrofluorocarbon (HFC) based refrigerants, for example, R-410A, R-407C, and R-134a, hydrofluoro olefin (HFO), unsaturated HFC based refrigerant, for example, R-1234ze, and R-1234yf, natural refrigerants, for example, R-717 and R-718, or any other suitable type of refrigerant.

The vapor compression system includes a control unit 5 that is operatively coupled to a drive mechanism of the compressor 2 to control operation of the vapor compression system.

It will be apparent to those skilled in the art from this disclosure that conventional compressor, condenser and expansion device may be used respectively as the compressor 2, the condenser 3 and the expansion device 4 in order to carry out the present invention. In other words, the compressor 2, the condenser 3 and the expansion device 4 are conventional components that are well known in the art. Since the compressor 2, the condenser 3 and the expansion device 4 are well known in the art, these structures will not be discussed or illustrated in detail herein. The vapor compression system may include a plurality of evaporators 1, compressors 2 and/or condensers 3.

Figure 3:
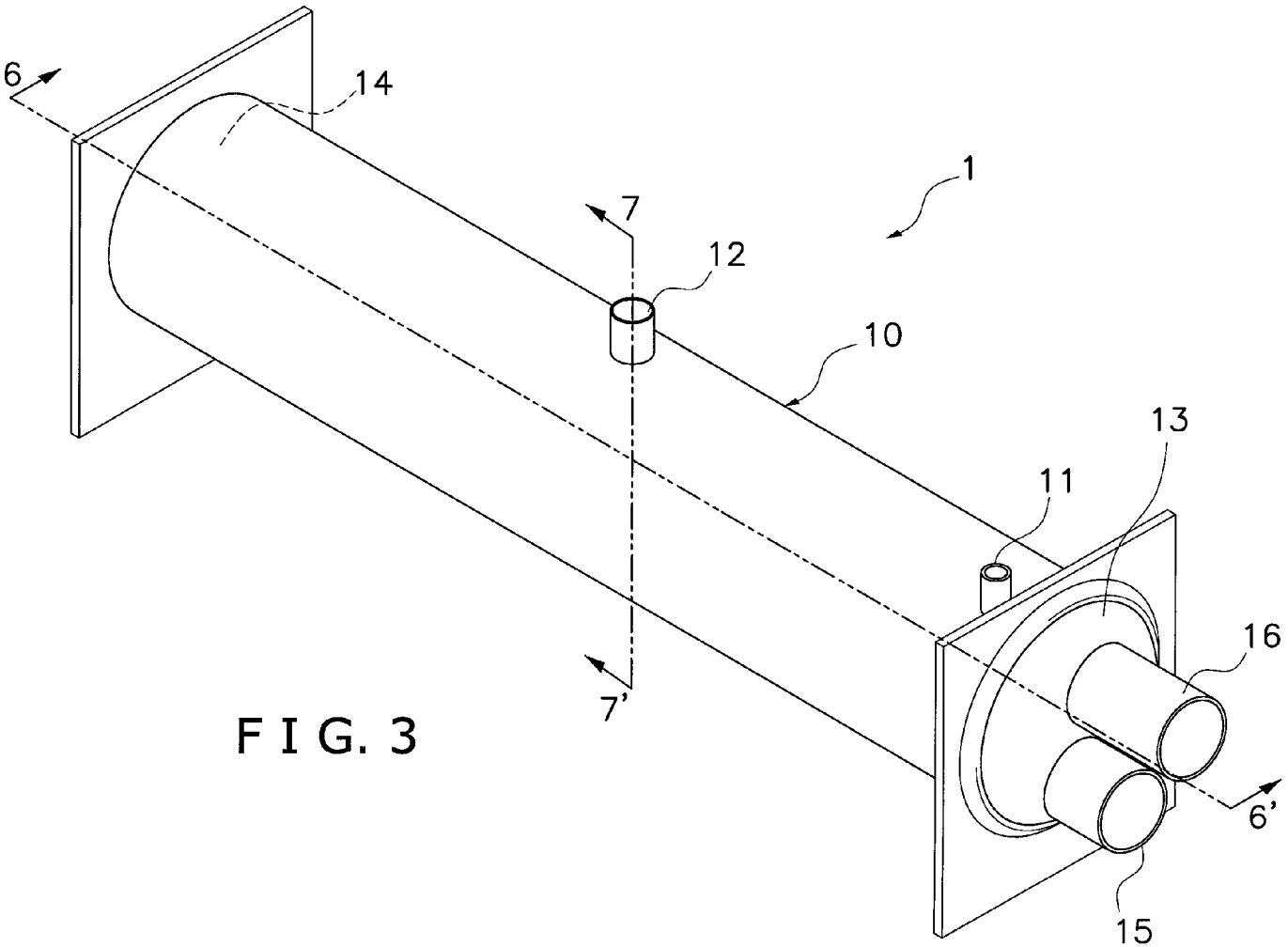
FIG. 3 is a simplified perspective view of the heat exchanger according to the first embodiment of the present invention.
Figure 4:
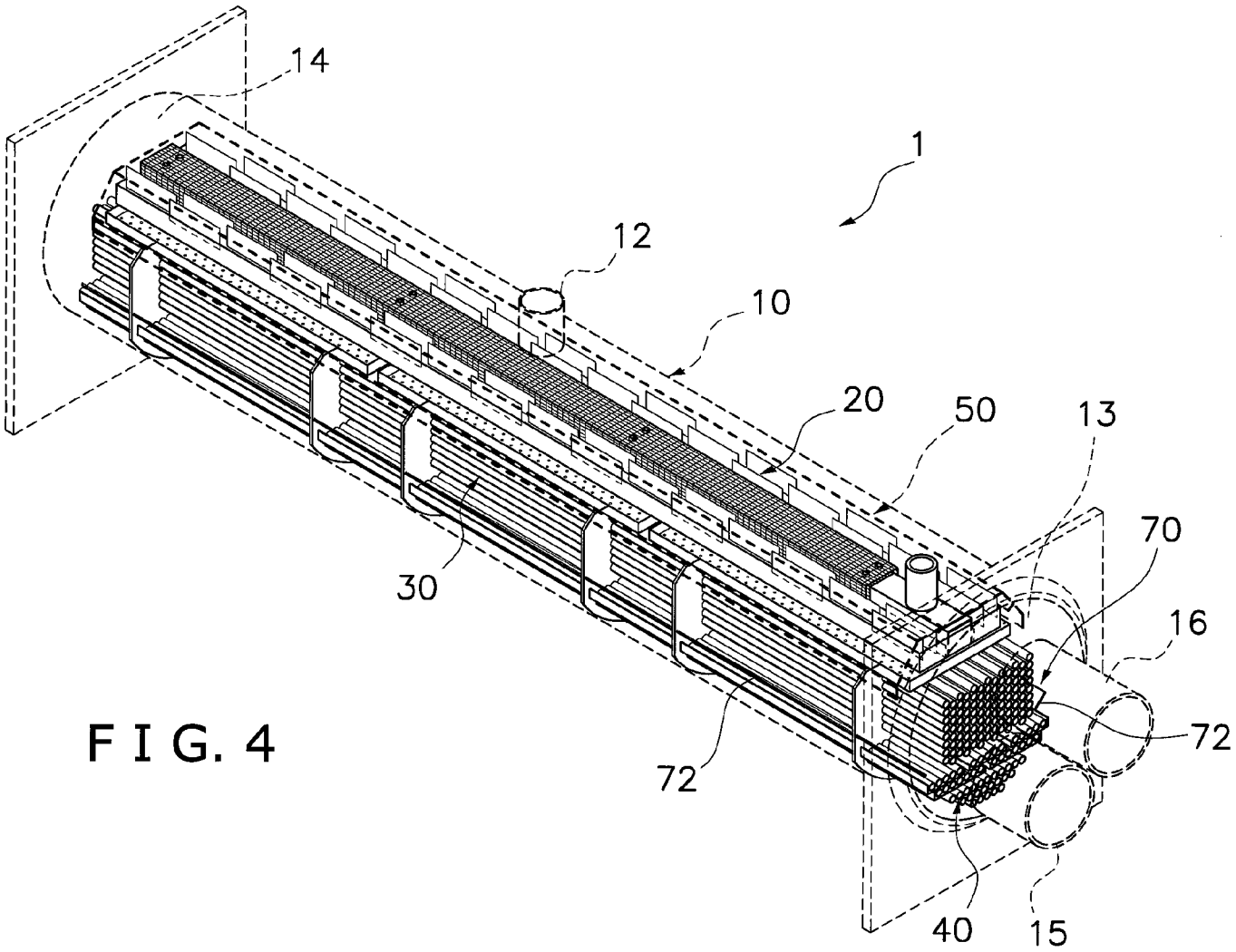
FIG. 4 is a simplified perspective view of an internal structure of the heat exchanger according to the first embodiment of the present invention.
Figure 5:
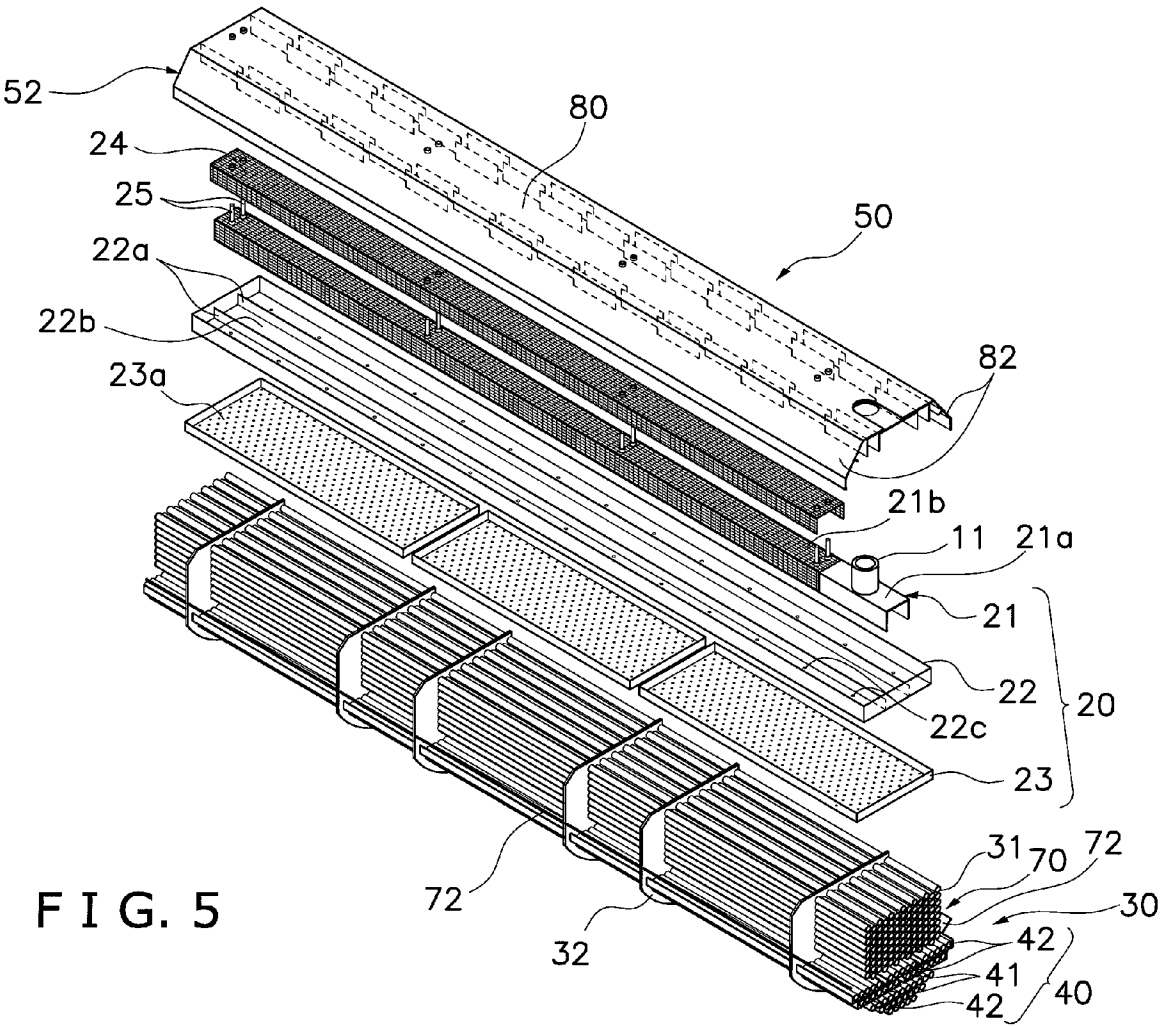
FIG. 5 is an exploded view of the internal structure of the heat exchanger according to the first embodiment of the present invention.
Figure 6:
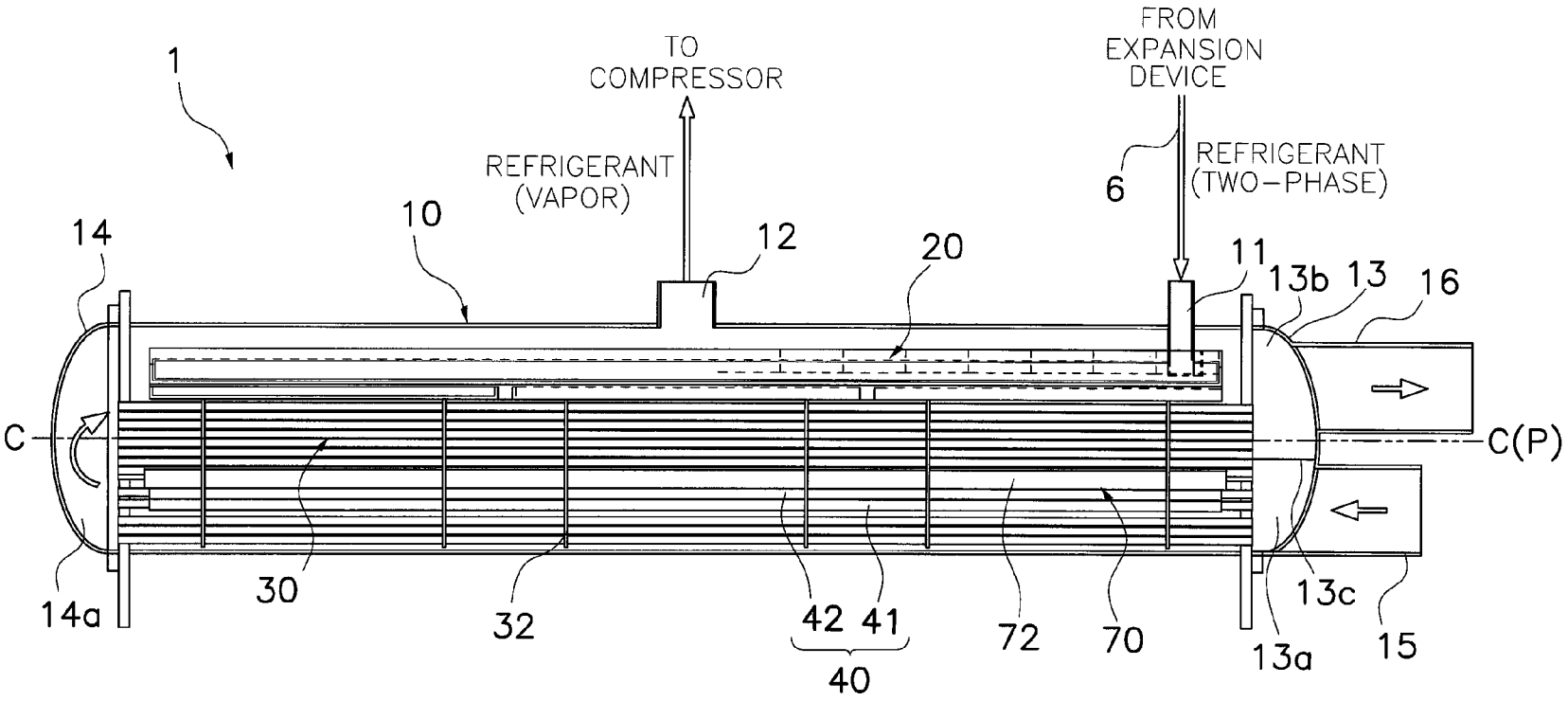
FIG. 6 is a simplified longitudinal cross sectional view of the heat exchanger according to the first embodiment of the present invention as taken along a section line 6-6' in FIG. 3.

Referring now to FIGS. 3 to 5, the detailed structure of the evaporator 1, which is the heat exchanger according to the first embodiment, will be explained. As shown in FIGS. 3 and 6, the evaporator 1 includes a shell 10 having a generally cylindrical shape with a longitudinal center axis C (FIG. 6) extending generally in the horizontal direction. The shell 10 includes a connection head member 13 defining an inlet water chamber 13*a* and an outlet water chamber 13*b*, and a return head member 14 defining a water chamber 14*a*. The connection head member 13 and the return head member 14 are fixedly coupled to longitudinal ends of a cylindrical body of the shell 10. The inlet water chamber 13*a* and the outlet water chamber 13*b* are partitioned by a water baffle 13*c*. The connection head member 13 includes a water inlet pipe 15 through which water enters the shell 10 and a water outlet pipe 16 through which the water is discharged from the shell 10. As shown in FIGS. 3 and 6, the shell 10 further includes a refrigerant inlet pipe 11 and a refrigerant outlet pipe 12. The refrigerant inlet pipe 11 is fluidly connected to the expansion device 4 via a supply conduit 6 (FIG. 7) to introduce the two-phase refrigerant into the shell 10. The expansion device 4 may be directly coupled at the refrigerant inlet pipe 11. The liquid component in the two-phase refrigerant boils and/or evaporates in the evaporator 1 and goes through phase change from liquid to vapor as it absorbs heat from the water passing through the evaporator 1. The vapor refrigerant is drawn from the refrigerant outlet pipe 12 to the compressor 2 by suction.

Figure 7:
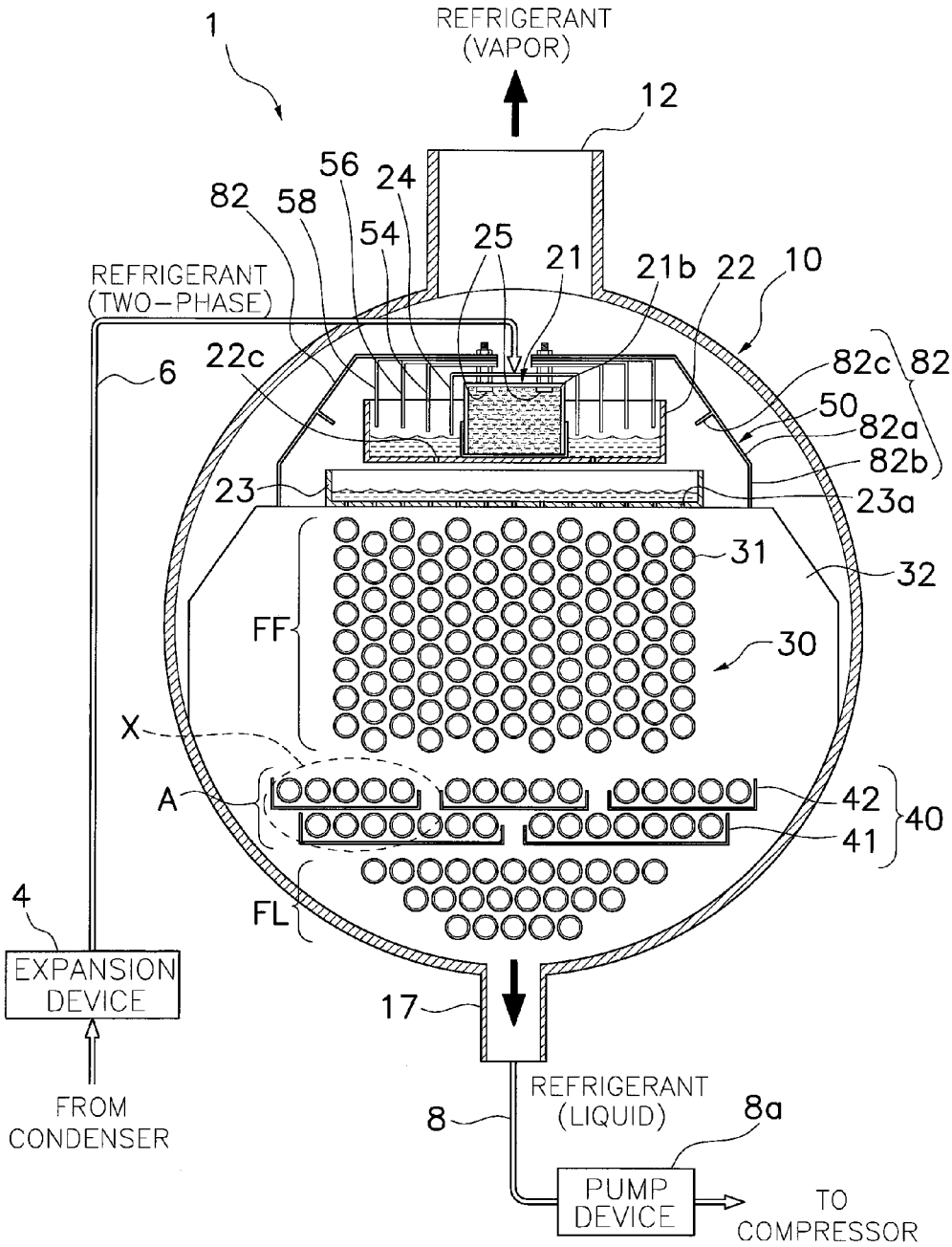
FIG. 7 is a simplified transverse cross sectional view of the heat exchanger according to the first embodiment of the present invention as taken along a section line 7-7' in FIG. 3.

FIG. 4 is a simplified perspective view illustrating an internal structure accommodated in the shell 10. FIG. 5 is an exploded view of the internal structure shown in FIG. 4. As shown in FIGS. 4 and 5, the evaporator 1 basically includes a distributing part 20, a tube bundle 30, and a trough part 40. The evaporator 1 preferably further includes a baffle structure 50 as shown in FIG. 7 although illustration of the baffle member 50 is omitted in FIGS. 4-6 for the sake of brevity. FIGS. 4-6 further illustrate a guide part, which is incorporated in some of the later embodiments for the sake of convenience, even though the guide part is optional and is not part of this embodiment.

The distributing part 20 is configured and arranged to serve as both a gas-liquid separator and a refrigerant distributor. As shown in FIG. 5, the distributing part 20 includes an inlet pipe part 21, a first tray part 22 and a plurality of second tray parts 23.

As shown in FIG. 6, the inlet pipe part 21 extends generally parallel to the longitudinal center axis C of the shell 10. The inlet pipe part 21 is fluidly connected to the refrigerant inlet pipe 11 of the shell 10 so that the two-phase refrigerant is introduced into the inlet pipe part 21 via the refrigerant inlet pipe 11. The inlet pipe part 21 has a rectangular cross-sectional configuration. The first tray part 22 has a structure that mates with the inlet pipe part 21 to form part of the rectangular cross-sectional shape of the inlet pipe portion 21.

The inlet pipe part 21 is fluidly connected to the refrigerant inlet pipe 11 of the shell 10 so that the two-phase refrigerant is introduced into the inlet pipe part 21 via the refrigerant inlet pipe 11. The inlet pipe part 21 preferably includes a first (supply) inverted U-shaped member 21*a* and a second (distribution) inverted U-shaped member 21*b* that are attached to the first tray part 22. The first (supply) inverted U-shaped member 21*a* is formed of a rigid metal sheet/plate material, which prevents liquid and gas refrigerant from passing therethrough. On the other hand, the second (distribution) inverted U-shaped member 21*b* is preferably formed of a rigid metal mesh (screen) material, which allows refrigerant liquid and gas to pass therethrough. The first and second inverted U-shaped members 21*a* and 21*b* are separate members (even though illustrated together in FIGS. 4-5), which are attached to the longitudinal center of the first tray part 22.

Referring to FIGS. 5-8, the first tray part 22 includes a pair of longitudinally extending flanges 22*a* extending upwardly from a bottom surface thereof to form a central longitudinal channel 22*b* along a direction parallel to the center longitudinal axis C. The flanges 22*a* can be integrally formed with the first tray part 22, can be separate flanges that are fixed to the first tray part 22 (e.g., by welding), or can be parts of a U-shaped channel that is attached to the bottom surface of the first tray part 22. In any case, the central longitudinal channel 22*b* is preferably free of openings. Meanwhile the areas on opposite lateral sides of the flanges 22*a* have holes 22*c* formed therein to pass refrigerant to the second tray part 23. In the illustrated embodiment, since the second (distribution) inverted U-shaped member 21*b* is preferably formed of a rigid metal mesh, the flanges 22*a* preferably extend to a predetermined height so that liquid refrigerant disposed in the channel 22*b* will flow over the flanges 22*a* upon exceeding the predetermined height.

Alternatively, the second (distribution) inverted U-shaped member 21*b* can be formed of solid sheet/plate metal, but with holes formed therein to allow liquid and or gas refrigerant to pass therethrough. In such a case, the holes should be disposed at the predetermined height. Also, in such a case, it is not necessary that the height of the flanges 22*a* determine when liquid refrigerant flows out of the second (distribution) inverted U-shaped member 21*b*, and thus, it is possible to make the flanges 22*a* shorter, if desired (i.e., because the height of the holes in the second (distribution) inverted U-shaped member 21*b* will determine at which height liquid refrigerant will flow through the holes.

There are no holes formed within the channel 22*b* but there are holes formed in the areas on both lateral sides of the channel 22*b*. The first and second inverted U-shaped members 21*a* and 21*b* are preferably dimensioned/sized to have free ends thereof received in the longitudinal channel 22*b* to form a rectangular cross-sectional tube structure together with the flanges 22*a* and the bottom surface of the first tray part 22. The first and second inverted U-shaped members 21*a* and 21*b* are attached to the flanges or the bottom of the first tray 22 by welding, by fasteners such as nuts/bolts or any other suitable attachment technique. In the illustrated embodiment, welding is used to attach first and second inverted U-shaped members 21*a* and 21*b* to the first tray part 22.

Figure 8:
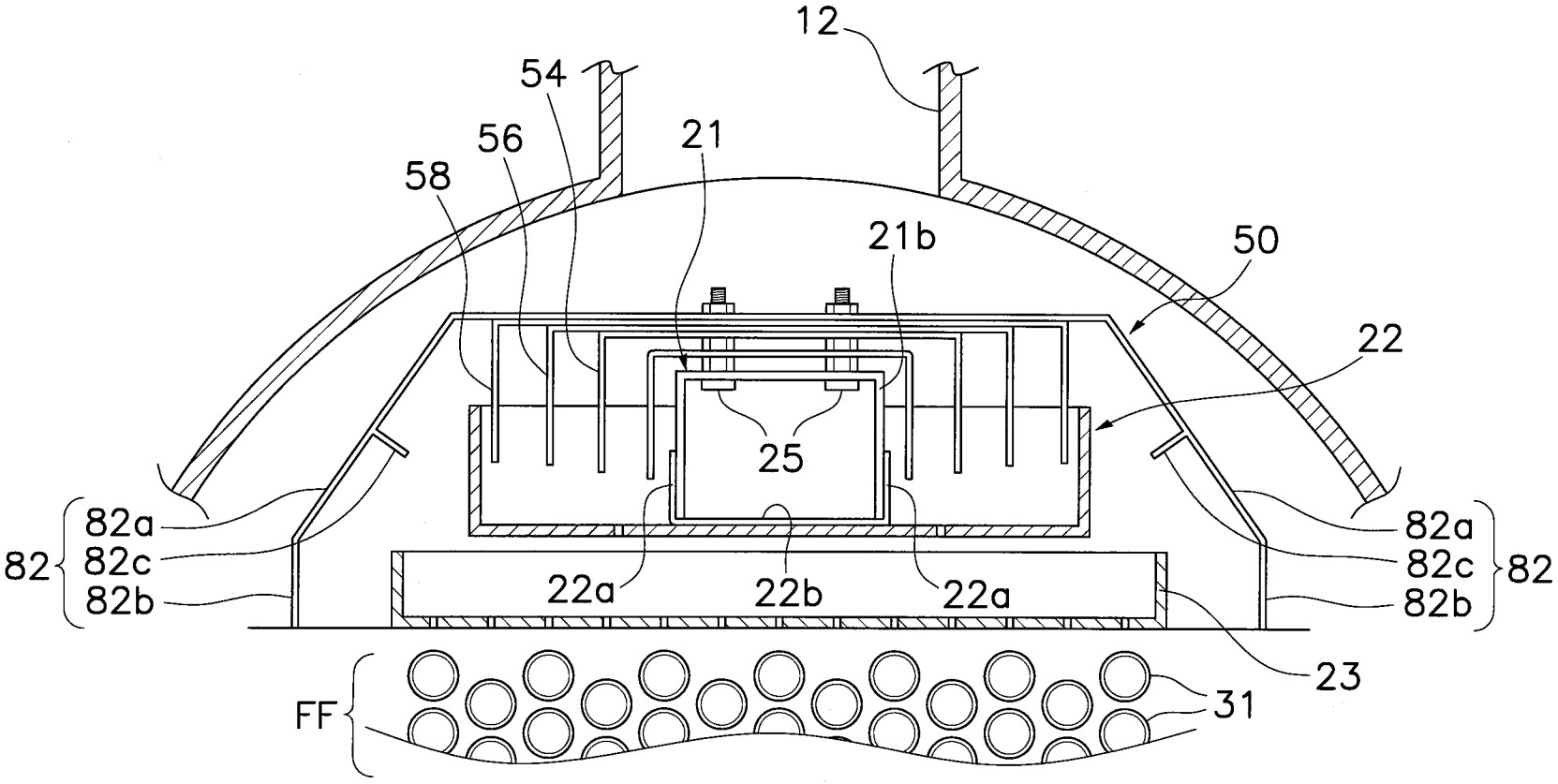
FIG. 8 is a further enlarged cross-sectional view of the upper portion of the heat exchanger illustrated in FIG. 7.

Referring still to FIGS. 5-8, an additional, larger third (distribution) inverted U-shaped member 24 is attached over the second (distribution) inverted U-shaped member 21*b* in a spaced relationship. Specifically, a plurality of bolts 25 extend upwardly through the second (distribution) inverted U-shaped member 21*b* and are attached thereto using nuts. The nuts act as spacers to mount the third (distribution) inverted U-shaped member 24 above the member 21*b*. The third (distribution) inverted U-shaped member 24 is laterally wider than the second (distribution) inverted U-shaped member 21*b* and has a height about the same or a little smaller. However, the nuts that act as spacers are relatively thin so that the free ends of the third (distribution) inverted U-shaped member 24 project downwardly below the top edges of the flanges 22*a* and are disposed above the bottom of the first tray 22, as best seen in FIG. 8. The free ends of the bolts 25 also extend through the third (distribution) inverted U-shaped member 24, and additional nuts are used to fix the third (distribution) inverted U-shaped member 24 to the second (distribution) inverted U-shaped member 21*b*. These additional nuts also act as spacers to space the baffle structure 50 upwardly from the third (distribution) inverted U-shaped member 24.

The third (distribution) inverted U-shaped member 24 impedes the flow of refrigerant vapor therethrough. When the two-phase refrigerant is discharged from the first inverted U-shaped member 21*a* of the inlet pipe part 21, the liquid component of the two-phase refrigerant discharged is received by the first tray part 22. On the other hand, the vapor component of the two-phase refrigerant flows upwardly and impinges the baffle structure 50 so that liquid droplets entrained in the vapor are captured by the baffle structure 50 and flow of gaseous refrigerant from the baffle structure 50 directly to the outlet pipe 12 is reduced.

As shown in FIGS. 5 and 7, the first tray part 22 has a plurality of first discharge apertures 22*c* from which the liquid refrigerant accumulated therein is discharged downwardly. The liquid refrigerant discharged from the first discharge apertures 22*c* of the first tray part 22 is received by one of the second tray parts 23 disposed below the first tray part 22.

As shown in FIGS. 5 and 6, the distributing part 20 of the first embodiment includes three identical second try parts 23. The second tray parts 23 are aligned side-by-side along the longitudinal center axis C of the shell 10. As shown in FIG. 6, an overall longitudinal length of the three second tray parts 23 is substantially the same as a longitudinal length of the first tray part 22 as shown in FIG. 6. A transverse width of the second tray part 23 is set to be larger than a transverse width of the first tray part 22 so that the second tray part 23 extends over substantially an entire width of the tube bundle 30 as shown in FIG. 7. The second tray parts 23 are arranged so that the liquid refrigerant accumulated in the second tray parts 23 does not communicate between the second tray parts 23. As shown in FIGS. 5 and 7, each of the second tray parts 23 has a plurality of second discharge apertures 23*a* from which the liquid refrigerant is discharged downwardly toward the tube bundle 30. Specifically, the second tray parts 23 preferably have a larger number of apertures 23*a* than the apertures 22*c* of the first tray part 22. It will be apparent to those skilled in the art from this disclosure that structure and configuration of the distributing part 20 is merely one preferable example and that the claims are not limited to the particular structure of the distributing part 20 disclosed herein.

Figure 9:
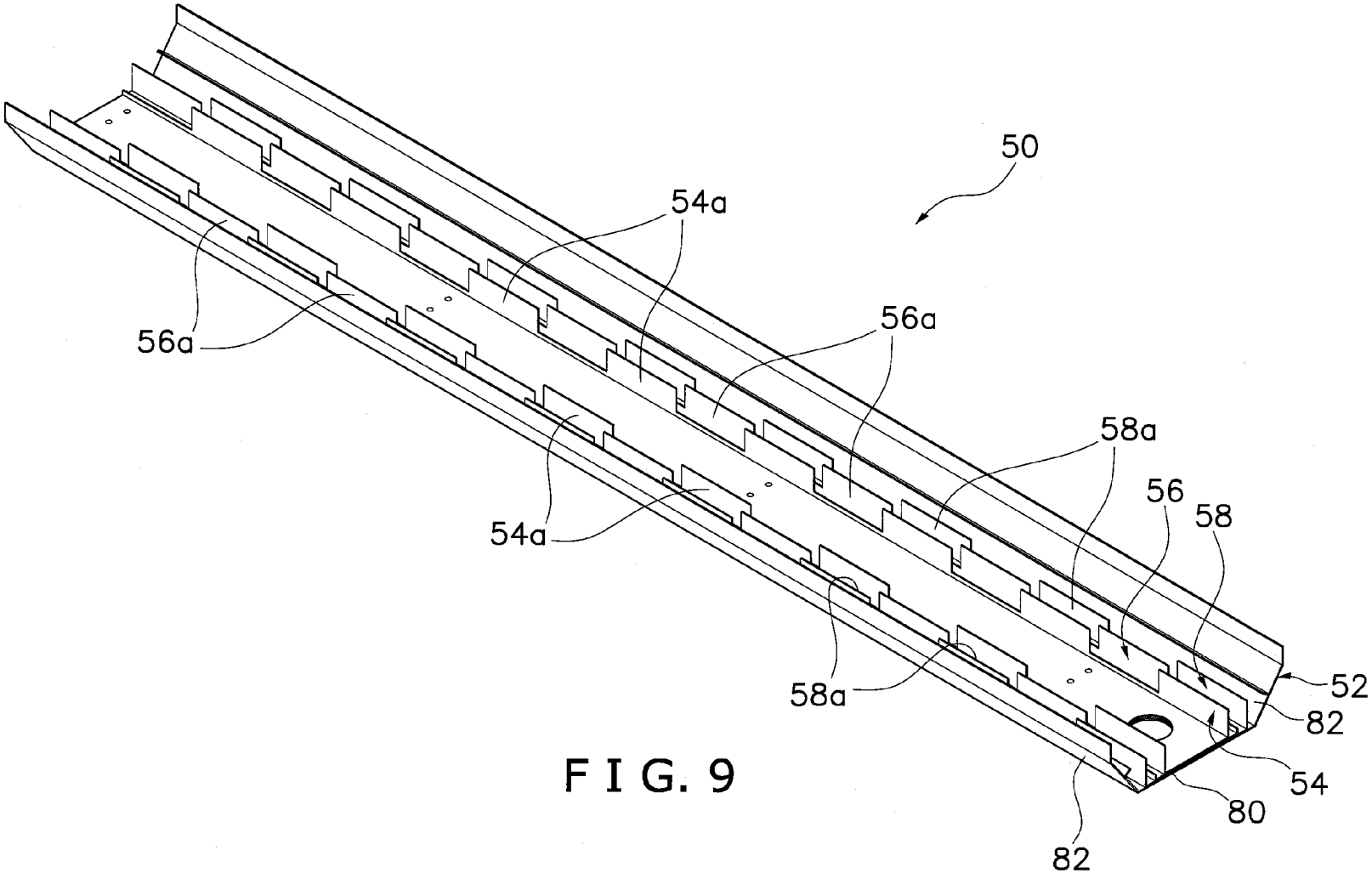
FIG. 9 is an inverted perspective view of the baffle structure of the heat exchanger according to the first embodiment of the present invention.

Referring to FIGS. 4-9, the baffle structure 50 basically includes a canopy member 52, a first baffle member 54, a second baffle member 56 and a third baffle member 58 that are fixed together by welding or any suitable attachment technique. The canopy member 52 is the upper most part of the baffle. The third baffle member 58 is immediately under the canopy member 52. The second baffle member 56 is immediately below the third baffle member 58. The first baffle member 54 is immediately below the second baffle member 56. Each of the first, second and third baffle members 54, 56 and 58 are formed as inverted U-shaped members from a metal sheet/plate material. The legs of the first, second and third baffle members 54, 56 and 58 have cutouts formed in linearly spaced, alternating manner as best seen in FIG. 9. Specifically, the third baffle member 58 includes a plurality of longitudinally spaced plate-shaped tab sections 58*a* that are longitudinally aligned with longitudinally spaced plate-shaped tab sections 54*a* of the first baffle member 54. The second baffle member 56 includes a plurality of longitudinally spaced plate-shaped tab sections 56*b* disposed longitudinally in the gaps between the tab sections 54*a* and 58*a*. This arrangement of the tab sections 54*a*, 56*b* and 58*a* form a serpentine route (in the gaps) for the flow of gaseous refrigerant, to impinge the flow of gaseous refrigerant, but to allow gaseous refrigerant to flow to some degree through the baffle members 54, 56 and 58.

As best seen in FIGS. 8-9, the canopy member 52 includes a central portion 80 and a pair of lateral side portions 82. The lateral side portions 82 are identical to each other, except that they are mirror images of each other. The first, second and third baffle members 54, 56 and 58 are attached to the central portion 80 so that the tab sections 54*a*, 56*b* and 58*a* project downwardly from the central portion 80 in the mounted position shown in FIG. 8. The central portion 80 and the first, second and third baffle members 54, 56 and 58 have openings formed therein to receive the bolts 25. The nuts used to secure third (distribution) inverted U-shaped member 24 space the baffle structure 50 upwardly by contacting the first baffle member 54. Nuts are then attached to the free ends of the bolts 25 to secure the baffle structure 50 so that the central portion 80 is positioned above the distributing part 20. The distributing part 20 can also be referred to as a refrigerant distribution assembly. The central portion 80 forms an attachment portion of the canopy member 52 attached at an upper end of the refrigerant distribution assembly.

The central portion 80 is a planar-shaped portion. The lateral side portions 82 extend laterally from lateral ends of the central portion 80. More specifically, the lateral side portions 82 extend laterally outwardly and downwardly from a position above the refrigerant distribution assembly 20, as viewed along the longitudinal center axis C. Each lateral side portion 82 includes an inclined section 82*a*, a vertical section 82*b* and a flange section 82*c*. Each lateral side portion 82 has a free end formed at a bottom end of the vertical section 82*b* that is disposed further from a vertical plane V passing through the longitudinal center axis C than the refrigerant distribution assembly 20, as viewed along the longitudinal center axis C, and lower than an upper edge of the outermost lateral end of the refrigerant distribution assembly 20 (an upper edge of the lateral ends of the second trays 23), as viewed along the longitudinal center axis C, as seen in FIG. 8.

The refrigerant distribution assembly 20 has a pair of outermost lateral ends, formed at the lateral ends of the second tray parts 23. The upper edge of the tray parts 23 form upper edges of the laterally outermost ends of the refrigerant distribution assembly 20. In the illustrated embodiment, the pair of lateral side portions 82 extend laterally outwardly and downwardly from positions above the refrigerant distribution assembly 20 so their free ends are disposed to contact vertical plates 32 (i.e., to a vertical position corresponding to the bottom of the second trays 23). The vertical plates 32 are discussed in more detail below. However, it will be apparent to those skilled in the art from this disclosure that the free ends of the lateral side portions 82 can be spaced upwardly from the vertical plates 32. In the illustrated embodiment, the flange sections 82*c* extend perpendicularly relative to the inclined sections 82*a* toward the refrigerant distribution assembly 20, and are approximately equally spaced from the central portion 80 and the vertical sections 82*b*.

The liquid droplets captured by the baffle structure 50 are guided toward the first and/or second tray parts 22 and 23. The vapor component flows laterally through the first, second and third baffle members 54, 56 and 58, downwardly along the lateral side portions 82 and then changes its direction upwardly toward the outlet pipe 12 at the free ends of the lateral side portions 82. The vapor refrigerant is discharged toward the compressor 2 via the outlet pipe 12. Due to the structure of the baffle structure 50 (i.e., the canopy member 52), vapor refrigerant velocity around the free end of the lateral side portions 82 is about 0.7 msec as compared to about 1.0 m/s with a conventional baffle member. Liquid drops in this 0.7 m/s velocity range are not accompanied by gas, and thus, almost all fall downward. Therefore, hardly any liquid refrigerant will be introduced in the gas refrigerant pipe. The baffle structure 50 (e.g. canopy member 52 can improve performance regardless of the structure of the heat transferring unit (tube bundle 30).

The tube bundle 30 is disposed below the distributing part 20 so that the liquid refrigerant discharged from the distributing part 20 is supplied onto the tube bundle 30. The tube bundle 30 includes a plurality of heat transfer tubes 31 that extend generally parallel to the longitudinal center axis C of the shell 10 as shown in FIG. 6. The heat transfer tubes 31 are made of materials having high thermal conductivity, such as metal. The heat transfer tubes 31 are preferably provided with interior and exterior grooves to further promote heat exchange between the refrigerant and the water flowing inside the heat transfer tubes 31. Such heat transfer tubes including the interior and exterior grooves are well known in the art. For example, Thermoexel-E tubes by Hitachi Cable Ltd. may be used as the heat transfer tubes 31 of this embodiment. As shown in FIG. 5, the heat transfer tubes 31 are supported by a plurality of vertically extending support plates 32, which are fixedly coupled to the shell 10.

In this embodiment, the tube bundle 30 is arranged to form a two-pass system, in which the heat transfer tubes 31 are divided into a supply line group disposed in a lower portion of the tube bundle 30, and a return line group disposed in an upper portion of the tube bundle 30. As shown in FIG. 6, inlet ends of the heat transfer tubes 31 in the supply line group are fluidly connected to the water inlet pipe 15 via the inlet water chamber 13*a* of the connection head member 13 so that water entering the evaporator 1 is distributed into the heat transfer tubes 31 in the supply line group. Outlet ends of the heat transfer tubes 31 in the supply line group and inlet ends of the heat transfer tubes 31 of the return line tubes are fluidly communicated with a water chamber 14*a* of the return head member 14. Therefore, the water flowing inside the heat transfer tubes 31 in the supply line group is discharged into the water chamber 14*a*, and redistributed into the heat transfer tubes 31 in the return line group. Outlet ends of the heat transfer tubes 31 in the return line group are fluidly communicated with the water outlet pipe 16 via the outlet water chamber 13*b* of the connection head member 13. Thus, the water flowing inside the heat transfer tubes 31 in the return line group exits the evaporator 1 through the water outlet pipe 16. In a typical two-pass evaporator, the temperature of the water entering at the water inlet pipe 15 may be about 54 degrees F. (about 12° C.), and the water is cooled to about 44 degrees F. (about 7° C.) when it exits from the water outlet pipe 16. Although, in this embodiment, the evaporator 1 is arranged to form a two-pass system in which the water goes in and out on the same side of the evaporator 1, it will be apparent to those skilled in the art from this disclosure that the other conventional system such as a one-pass or three-pass system may be used. Moreover, in the two-pass system, the return line group may be disposed below or side-by-side with the supply line group instead of the arrangement illustrated herein.

The detailed arrangement for a heat transfer mechanism of the evaporator 1 according to the first embodiment will be explained with reference to FIG. 7. FIG. 7 is a simplified transverse cross sectional view of the evaporator 1 taken along a section line 7-7' in FIG. 3.

As described above, the refrigerant in a two-phase state is supplied through the supply conduit 6 to the inlet pipe part 21 of the distributing part 20 via the inlet pipe 11. In FIG. 7, the flow of refrigerant in the refrigeration circuit is schematically illustrated, and the inlet pipe 11 is omitted for the sake of brevity. The vapor component of the refrigerant supplied to the distributing part 20 is separated from the liquid component in the first tray part 22 of the distributing part 20 and exits the evaporator 1 through the outlet pipe 12. On the other hand, the liquid component of the two-phase refrigerant is accumulated in the first tray part 22 and then in the second tray parts 23, and discharged from the discharge apertures 23*a* of the second tray part 23 downwardly towards the tube bundle 30.

As shown in FIG. 7, the tube bundle 30 includes a falling film region FF, an accumulating region A and a flooded region FL. The heat transfer tubes 31 in the falling film region FF are configured and arranged to perform falling film evaporation of the liquid refrigerant. More specifically, the heat transfer tubes 31 in the falling film region FF are arranged such that the liquid refrigerant discharged from the distributing part 20 forms a layer (or a film) along an exterior wall of each of the heat transfer tubes 31, where the liquid refrigerant evaporates as vapor refrigerant while it absorbs heat from the water flowing inside the heat transfer tubes 31. As shown in FIG. 7, the heat transfer tubes 31 in the falling film region FF are arranged in a plurality of vertical columns extending parallel to each other when seen in a direction parallel to the longitudinal center axis C of the shell 10 (as shown in FIG. 7). Therefore, the refrigerant falls downwardly from one heat transfer tube to another by force of gravity in each of the columns of the heat transfer tubes 31. The columns of the heat transfer tubes 31 are disposed with respect to the second discharge openings 23*a* of the second tray part 23 so that the liquid refrigerant discharged from the second discharge openings 23*a* is deposited onto an uppermost one of the heat transfer tubes 31 in each of the columns. In the illustrated embodiment, the columns of the heat transfer tubes 31 in the falling film region FF are arranged in a staggered pattern as shown in FIG. 7. A vertical pitch between two adjacent ones of the heat transfer tubes 31 in the falling film region FF is substantially constant. Likewise, a horizontal pitch between two adjacent ones of the columns of the heat transfer tubes 31 in the falling film region FF is substantially constant.

The liquid refrigerant that did not evaporate in the falling film region FF continues falling downwardly by force of gravity into the accumulating region A, where the trough part 40 is provided as shown in FIG. 7. The trough part 40 is configured and arranged to accumulate the liquid refrigerant flowing from above so that the heat transfer tubes 31 in the accumulating region A are at least partially immersed in the liquid refrigerant that is accumulated in the trough part 40. In the example shown in FIG. 7, the trough part 40 is provided to two rows of the heat transfer tubes 31 in the accumulating region A.

As shown in FIG. 7, the trough part 40 includes two first trough sections 41 and three second trough sections 42. As seen in FIG. 6, the first trough sections 41 and the second trough sections 42 extend generally parallel to the longitudinal center axis C of the shell 10 over a longitudinal length that is substantially the same as a longitudinal length of the heat transfer tubes 31. The first trough sections 41 and the second trough sections 42 of the trough part 40 are spaced apart from an interior surface of the shell 10 when viewed along the longitudinal center axis C as seen in FIG. 7. The first trough sections 41 and the second trough sections 42 may be made of a variety of materials such as metal, alloy, resin, etc. In this embodiment, the first trough sections 41 and the second trough sections 42 are made of metallic material, such as a steel plate (steel sheet). The first trough sections 41 and the second trough sections 42 are supported by the support plates 32. The support plates 32 include openings (not shown) disposed at positions corresponding to an internal region of the first trough sections 41 so that all segments of each of the trough sections 41 are in fluid communication along the longitudinal length of the first trough sections 41. Therefore, the liquid refrigerant accumulated in the first trough section 41 fluidly communicates via the openings in the support plates 32 along the longitudinal length of the trough sections 41. Likewise, openings (not shown) are provided in the support plates 32 at positions corresponding to an internal region of each of the second trough sections 42 so that all segments of the second trough section 42 are in fluid communication along the longitudinal length of the second trough section 42. Therefore, the liquid refrigerant accumulated in the trough sections 42 fluidly communicates via the openings in the support plates 32 along the longitudinal length of the second trough sections 42.

As shown in FIG. 7, the first trough sections 41 are disposed below the lowermost row of the heat transfer tubes 31 in the accumulating region A while the second trough sections 42 are disposed below the second lowermost row of the heat transfer tubes 31 in the accumulating region A. As shown in FIG. 7, the second lowermost row in of the heat transfer tubes 31 in the accumulating region A is divided into three groups, and each of the second trough sections 42 is respectively disposed below each of the three groups. A gap is formed between the second trough sections 42 to allow an overflow of the liquid refrigerant from the second trough sections 42 toward the first trough sections 41.

In this embodiment, the heat transfer tubes 31 in the accumulating region A are arranged so that an outermost one of the heat transfer tubes 31 in each row of the accumulating region A is disposed outwardly of an outermost column of the heat transfer tubes 31 in the falling film region FF on each side of the tube bundle 30 as shown in FIG. 7. Since the flow of liquid refrigerant tends to flare outwardly as it progresses toward the lower region of the tube bundle 30 due to vapor flow within the shell 10, it is preferable to provide at least one heat transfer tube in each row of the accumulating region A, which is disposed outwardly of the outermost column of the heat transfer tubes 31 in the falling film region FF as shown in FIG. 7.

The first trough sections 41 are wider and fewer in number than the second trough sections 42. Each of the trough sections 41 includes a bottom wall portion 41*a* and a pair of side wall portions 41*b*. Similarly, each of the trough sections 42 includes a bottom wall portion 42*a* and a pair of side wall portions 42*b*. The side wall portions 41*b* and 42*b* have different heights depending on their location. The side wall portions 41*b* and 42*b* of the respective trough sections are mirrors images of each other, except for their heights in certain locations. Other than different heights (in some cases) and being mirror images of each other, the side wall portions 41*b* and 42*b* are identical to each other, and thus, will be given the same reference numerals for the sake of convenience.

In this embodiment, the heat transfer tubes 31 in the accumulating region A are arranged in two horizontal rows when viewed along the longitudinal center axis C of the shell 10. The trough part 40 includes a plurality of trough sections 41 and 42 disposed below the horizontal rows in a number of tiers (e.g., two in this embodiment) corresponding to a number of the horizontal rows of the heat transfer tubes 31 in the accumulating region A as viewed along the longitudinal center axis C. Two of the sidewall portions 41*b* in the first (lower) tier form outermost lateral ends of the first (lower) tier and a remaining number of the side wall portions 41*b* form inner side wall portions of the first (lower) tier. Any inner side wall portions 41*b* of the first (lower) tier have vertical heights smaller than the two of the side wall portions 41*b* forming the outermost lateral ends of the first (lower) tier. Similarly, two of the sidewall portions 42*b* in the second (upper) tier form outermost lateral ends of the second (upper) tier and a remaining number of the side wall portions 42*b* form inner side wall portions of the second (upper) tier. Any inner side wall portions 42*b* of the second (upper) tier have vertical heights smaller than the two of the side wall portions 42*b* forming the outermost lateral ends of the second (upper) tier. This arrangement can be best understood from FIGS. 7 and 10-12.

Thus, two of the side wall portions 41*b*/42*b* of the trough sections 41/42 in each tier form outermost lateral ends of the tier and a remaining number of the side wall portions 41*b*/42*b* form inner side wall portions of the tier, and any inner side wall portions 41*b*/42*b* of each tier have vertical heights smaller than the two of the side wall portions 41*b*/42*b* forming the outermost lateral ends of the tier. The inner side wall portions 41*b*/42*b* of each tier extend vertically upward from the bottom wall portions 41*a*/42*b* to positions overlapping at least 50% of the heat transfer tubes 31 in the horizontal row above the tier. In the illustrated embodiment 50% of the heat transfer tubes 31 in the tier are overlapped by the inner side wall portions 41*b*/42*b*. The outer side wall portions 41*b*/42*b* vertically overlap about 100% of the heat transfer tubes in the tier. Therefore liquid refrigerant overflowing each tier will flow over the inner side wall portions 41*b*/42*b*, and not over the two of the side wall portions 41*b*/42*b* forming outermost lateral ends of the tier.

In the illustrated embodiment, the heat transfer tubes 31 in the accumulating region A are arranged in two horizontal rows when viewed along the longitudinal center axis C of the shell 10, and the trough part 40 continuously extends laterally under the heat transfer tubes 31 disposed in the accumulating region A. In this embodiment D1 represents an overlapping distance (height) of the inner side wall portions 41*b*/42*b*, while D2 represents an overlapping distance (height) of the outermost side wall portions 41*b*/42*b*. Preferably D1/D2≥0.5 as mentioned above (e.g. 0.5 in the illustrated embodiment).

Figure 10:
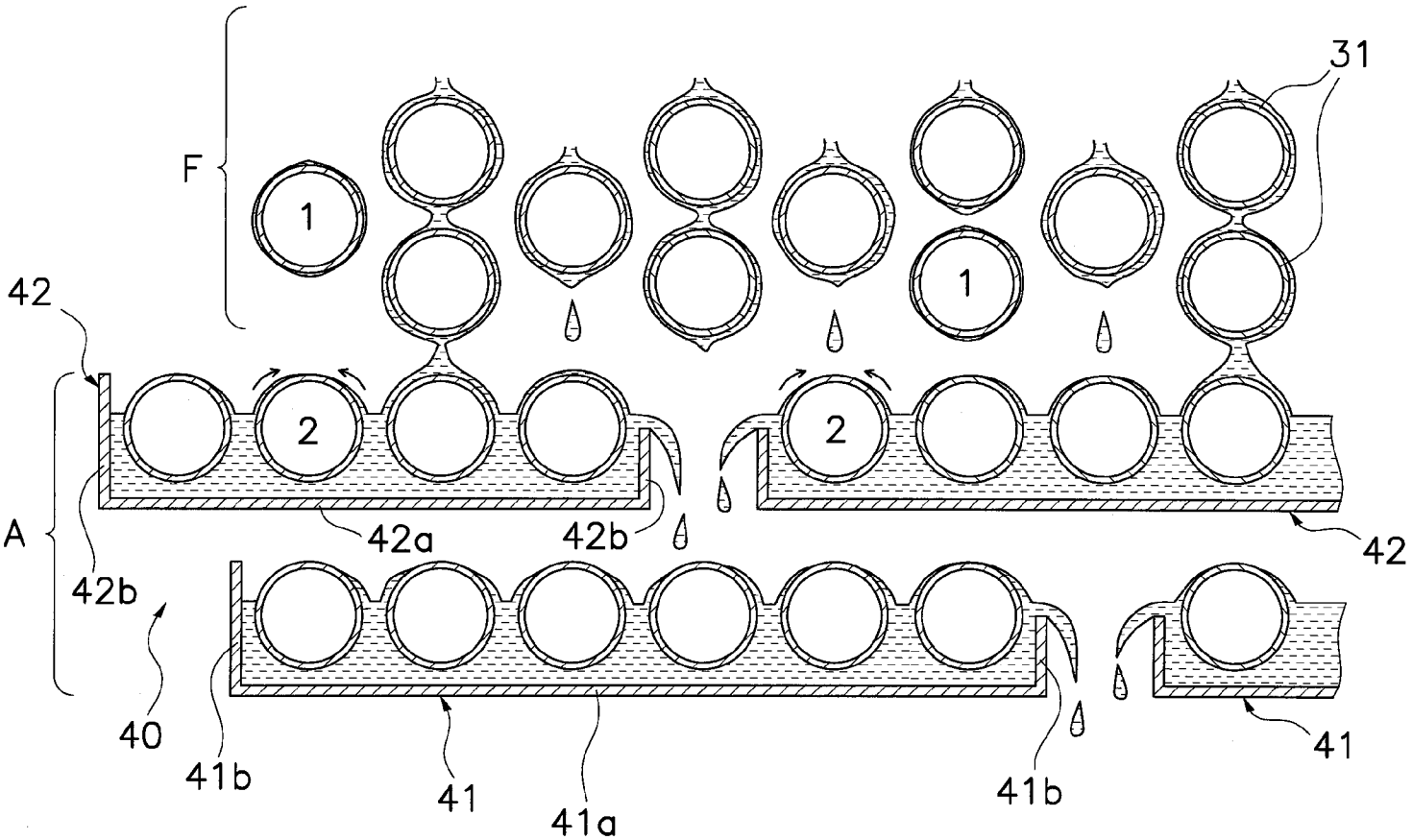
FIG. 10 is an enlarged schematic cross sectional view of heat transfer tubes and a trough part disposed in region X in FIG. 7 illustrating a state in which the heat exchanger is in use according to the first embodiment of the present invention.

FIG. 10 shows an enlarged cross sectional view of the region X in FIG. 7 schematically illustrating a state in which the evaporator 1 is in use under normal conditions. Water flowing inside the heat transfer tubes 31 is not illustrated in FIG. 8 for the sake of brevity. As shown in FIG. 10, the liquid refrigerant forms films along the exterior surfaces of the heat transfer tubes 31 in the falling film region FF and part of the liquid refrigerant evaporates as the vapor refrigerant. Thus, an amount of the liquid refrigerant falling along the heat transfer tubes 31 decreases as it progresses toward the lower region of the tube bundle 30 while the liquid refrigerant evaporates as the vapor refrigerant. Moreover, if distribution of the liquid refrigerant from the distributing part 20 is not even, there is more chance of formation of dry patches in the heat transfer tubes 31 disposed in a lower region of the tube bundle 30, which is detrimental to heat transfer. Thus, in this embodiment of the present invention, the trough part 40 is provided in the accumulating region A, which is disposed in the lower region of the tube bundle 30, to accumulate the liquid refrigerant flowing from above and to redistribute the accumulated refrigerant along the longitudinal direction of the shell C. Therefore, all of the heat transfer tubes 31 in the accumulating region A are at least partially immersed in the liquid refrigerant collected in the trough part 40 according to the first embodiment. Thus, formation of dry patch in the lower region of the tube bundle 30 can be prevented, and good heat transfer efficiency of the evaporator 1 can be ensured.

For example, as shown in FIG. 8, if the heat transfer tubes 31 marked "1" receive little refrigerant, the heat transfer tubes 31 marked "2", which are disposed immediately below the ones marked "1," will receive the liquid refrigerant from above. However, the liquid refrigerant is accumulated in the second trough sections 42 as the liquid refrigerant flows along the other heat transfer tubes 31. Therefore, the heat transfer tubes 31 immediately above the second trough sections 42 are at least partially immersed in the liquid refrigerant accumulated in the second trough sections 42. Moreover, even when the heat transfer tubes 31 are only partially immersed in the liquid refrigerant accumulated in the second trough section 42 (i.e., a part of each of the heat transfer tubes 31 is exposed), the liquid refrigerant accumulated in the trough sections 42 rises up along exposed surfaces of the exterior walls of the heat transfer tubes 31 as indicated by the arrows shown in FIG. 10 due to capillary action. Therefore, the liquid refrigerant accumulated in the second trough sections 42 boils and/or evaporates while absorbing heat from the water passing through the heat transfer tubes 31. Moreover, the second trough sections 42 are designed to allow the liquid refrigerant to overflow from the second trough sections 42 onto the first trough section 41. The heat transfer tubes 31 that are disposed immediately above the first trough sections 41 are also at least partially immersed in the liquid refrigerant accumulated in the first trough sections 41 as shown in FIG. 10. Moreover, even when the heat transfer tubes 31 are only partially immersed in the liquid refrigerant accumulated in the second trough sections 41 (i.e., a part of each of the heat transfer tubes 31 is exposed), the liquid refrigerant in the trough sections 41 rises up along exposed surfaces of the exterior walls of the heat transfer tubes 31 that are at least partially immersed in the accumulated refrigerant due to capillary action. Therefore, the liquid refrigerant accumulated in the first trough sections 41 boils and/or evaporates while absorbing heat from the water passing inside the heat transfer tubes 31. Accordingly, heat transfer effectively takes place between the liquid refrigerant and the water flowing inside the heat transfer tubes 31 in the accumulating region A.

Figure 11:
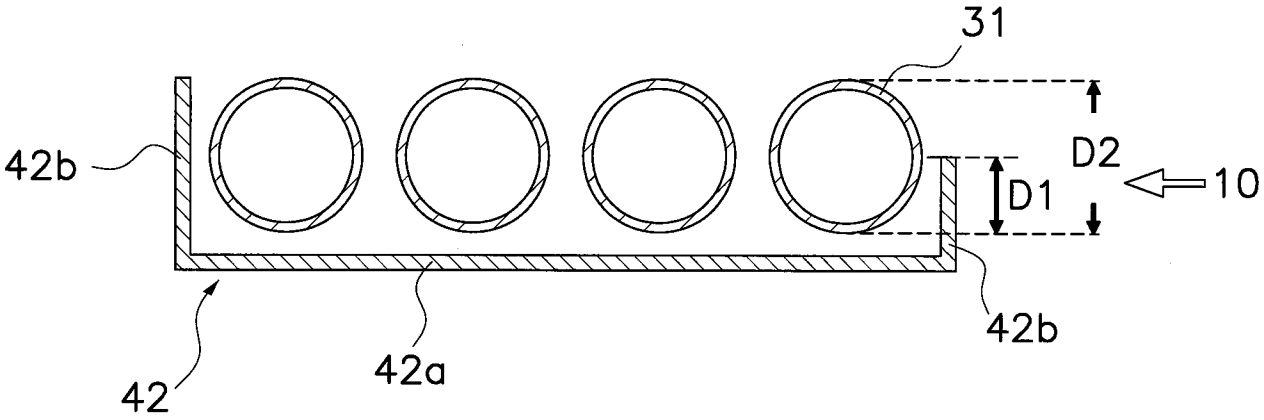
FIG. 11 is an enlarged cross sectional view of the heat transfer tubes and one of trough sections of the trough part of FIG. 10.
Figure 12:
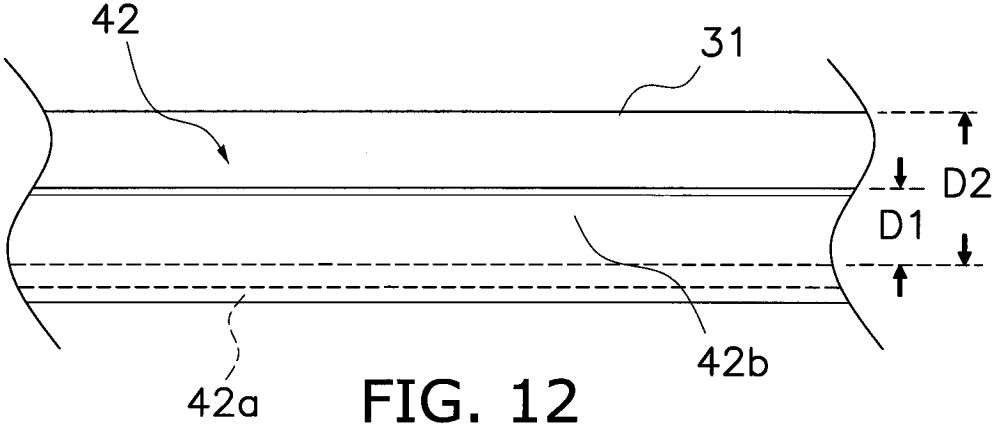
FIG. 12 is a partial side elevational view of the heat transfer tubes and the trough section of FIG. 11 as seen in a direction along an arrow 12 in FIG. 11.
Figure 13:
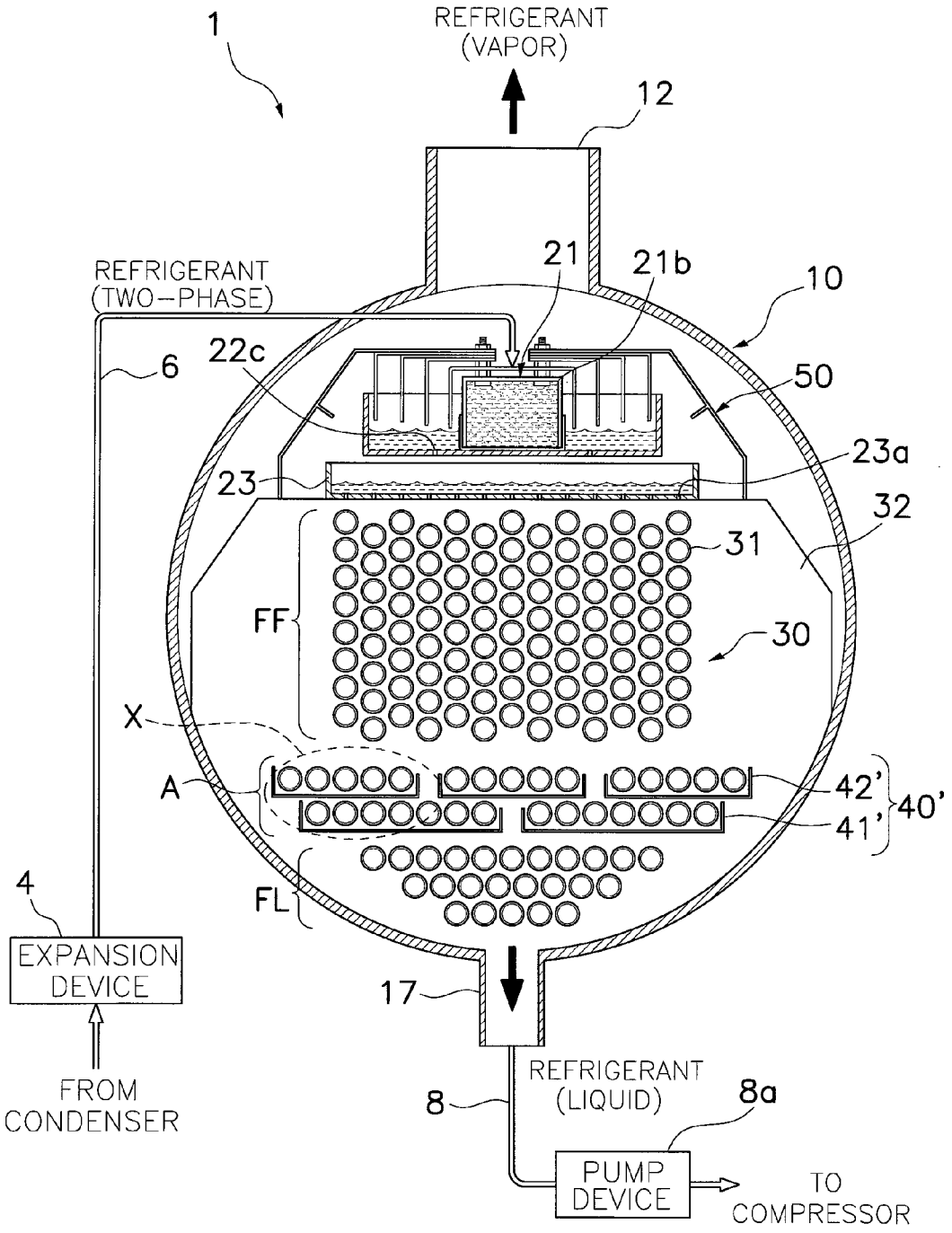
FIG. 13 is a simplified transverse cross sectional view of the heat exchanger illustrating a modified example for an arrangement of a tube bundle and a trough part according to the first embodiment of the present invention.
Figure 14:
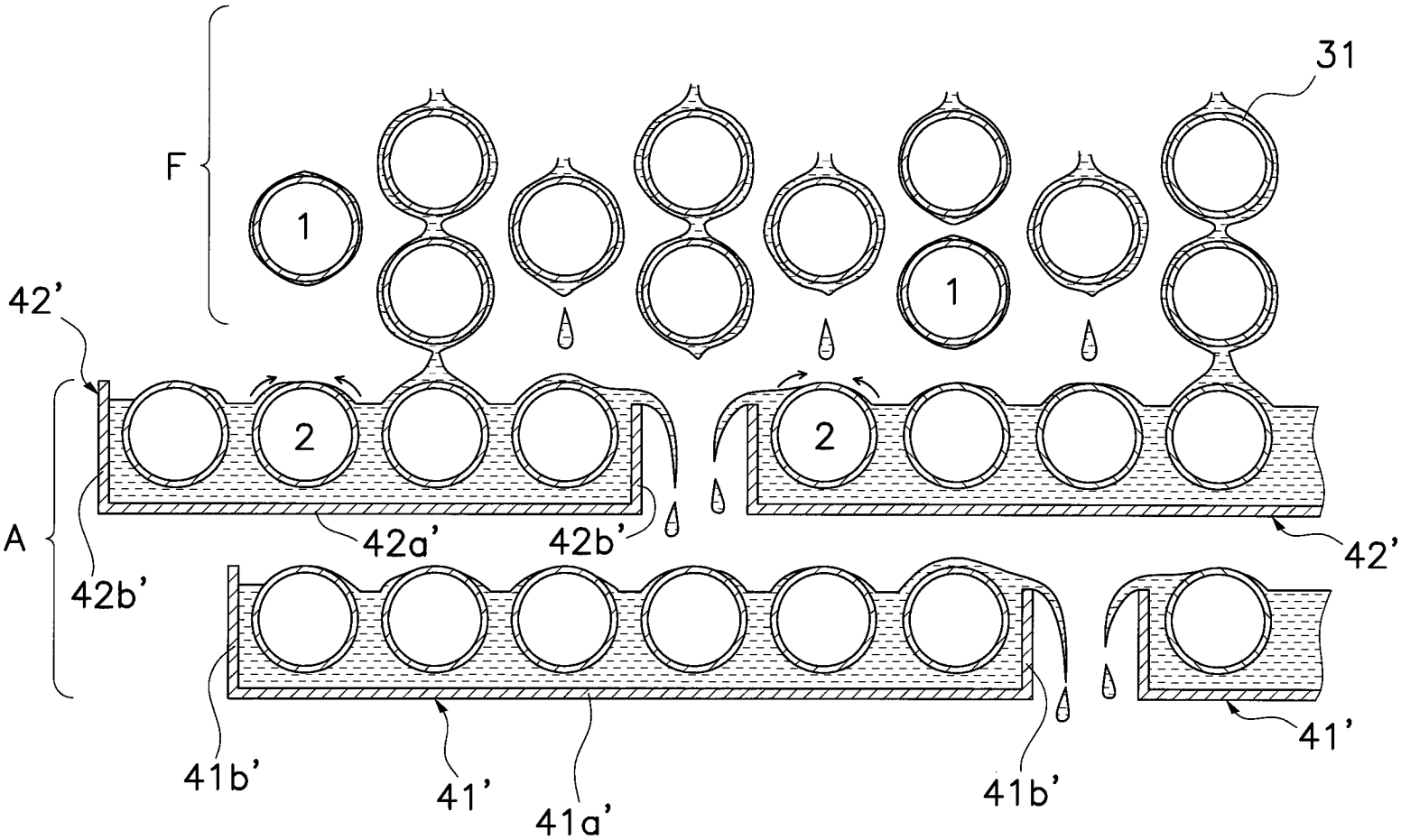
FIG. 14 is an enlarged schematic cross sectional view of heat transfer tubes and a trough part disposed in region X in FIG. 13 illustrating a state in which the heat exchanger is in use according to the modified example of the first embodiment of the present invention.
Figure 15:
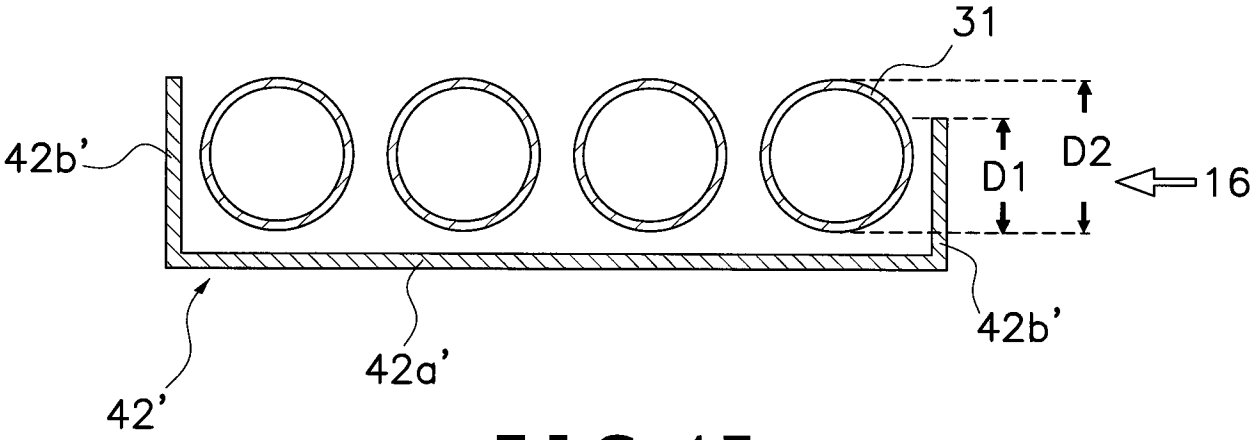
FIG. 15 is an enlarged cross sectional view of the heat transfer tubes and one of the trough sections of the trough part of FIG. 14.
Figure 16:
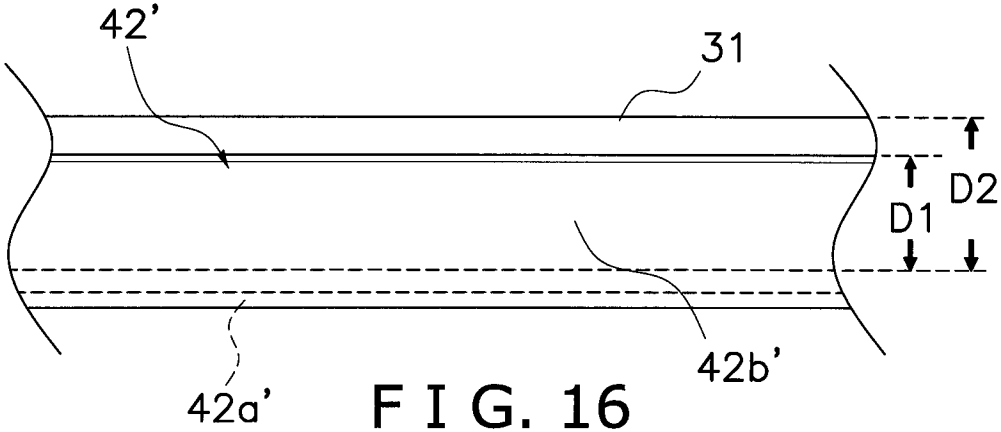
FIG. 16 is a partial side elevational view of the heat transfer tubes and the trough section of FIG. 15 as seen in a direction along an arrow 16 in FIG. 15.

With reference to FIGS. 11 and 12, the detailed structure of the first trough sections 41 and the second trough sections 42, with reference to one of the second trough sections 42 will be explained. The bottom wall portion 42*a* and the side wall portions 42*b* form a recess in which the liquid refrigerant is accumulated so that the heat transfer tubes 31 are at least partially immersed in the liquid refrigerant accumulated in the second trough section 42 when the evaporator 1 is operated under normal conditions. More specifically, the side wall portions 42*b* of the second trough part 42 partially overlap with the heat transfer tubes 31 disposed directly above the second trough part 42 when viewed along a horizontal direction perpendicular to the longitudinal center axis C of the shell 10. FIG. 12 shows the trough section 42 and the heat transfer tubes 31 when viewed along the horizontal direction perpendicular to the longitudinal center axis C of the shell 10. As mentioned above, the overlapping distance D1 is set to be equal to or greater than one-half of a height (outer diameter) D2 of the heat transfer tube 31 (D1/D2≥0.5). The first trough sections 41 have the same structure as the second trough sections 42 as described above, except that the first trough sections 41 are laterally wider. Therefore, liquid refrigerant will overflow the inner side walls 41*b* to flow down to the flooded region FL, which will now be discussed.

Referring again to FIG. 7, the flooded region FL includes the plurality of the heat transfer tubes 31 disposed in a group below the accumulating region at the bottom portion of the hub shell 11. Due to the configuration of the tube bundle 30 with the accumulating region A and the falling film region FF, the number of tubes 31 in the flooded region FL and the overall size (depth) of the flooded region FL can be made smaller. Therefore the amount of refrigerant can be reduced without decreasing performance.

In this embodiment, a fluid conduit 8 is fluidly connected to the flooded region FL within the shell 10. Specifically, the shell 10 includes a bottom outlet pipe 17 in fluid communication with the conduit 8. A pump device 8 is connected to the fluid conduit 8 to return the fluid from the bottom of the shell 10 to the compressor 2. The pump 8*a* can be selectively operated when the liquid accumulated in the flooded region FL reaches a prescribed level to discharge the liquid therefrom to outside of the evaporator 1. In the illustrated embodiment, the fluid conduit 8 is connected to a bottom most point of the flooded region FL. However, it will be apparent to those skilled in the art from this disclosure that the fluid conduit 8 can be coupled to the flooded region FL at a location spaced from the bottom most point of the flooded region. In any case, the fluid conduit 8 is preferably fluidly connected to the flooded region FL at a location between the bottom most point of the flooded region and a location corresponding to the level of liquid in the flooded region (e.g., between the bottom most point and the top tier of tubes 31 in the flooded region FL). Moreover, it will be apparent to those skilled in the art from this disclosure that the pump device 8*a* could instead be an ejector. In the case, where the pump device 8*a* is replaced with an ejector, the ejector also receives compressed refrigerant from the compressor 2. The ejector can then mix the compressed refrigerant from the compressor 2 with the liquid received from the flooded region FL so that a particular oil concentration can be supplied back to the compressor 2. Pumps such as pump 8 and ejectors such as that mentioned above are well known in the art and thus, will not be explained or illustrated in further detail herein.

In the illustrated embodiment, the refrigerant supplied to the evaporator 1 includes oil (e.g. in a concentration of 0.5 wt %). As the refrigerant/oil undergoes heat exchange and evaporation in the evaporator 1, oil concentration within the evaporator 1 gradually increases as liquid travels lower in the evaporator. For example, in this embodiment, oil concentration in the falling film region FF will be between 0.5 wt % and 1 wt %. In the accumulating region A, oil concentration will be between 2 wt % and 10 wt % (e.g., 2 wt % in the upper trough section 42, and 10 wt % in the lower trough section 41). In the flooded region FL, oil concentration will reach 30 wt %. In the flooded region FL, oil concentration will reach 30 wt % even if the trough part 40 is modified in accordance with the following embodiments. However, due to the arrangements disclosed herein, oil concentration can be increased gradually in the downward direction so as not to adversely affect heat transfer as much as convention techniques. In addition, due to the arrangements disclosed herein, a size of the flooded region can be reduced and thus, an amount of refrigerant can also be reduced.

The arrangements for the tube bundle 30 and the trough part 40 are not limited to the ones illustrated in FIG. 7. It will be apparent to those skilled in the art from this disclosure that various changes and modifications can be made herein without departing from the scope of the invention. Several modified examples will be explained below.

Modification of First Embodiment

Referring now to FIGS. 13-16, an evaporator 1' is illustrated in accordance with a modification of the first embodiment. The evaporator 1' is identical to the evaporator 1, except the evaporator includes a modified trough part 40'. In view of the similarity between this modification of the first embodiment and the first embodiment, the parts of this modification of the first embodiment that are identical to the parts of the first embodiment will be given the same reference numerals as the parts of the first embodiment. Moreover, the descriptions of the parts of this modification of the first embodiment that are identical to the parts of the first embodiment may be omitted for the sake of brevity. Moreover, it will be apparent to those skilled in the art from this disclosure that the descriptions and illustrations of the preceding embodiment also apply to this modification of the first embodiment, except as explained and illustrated herein.

The modified trough part 40' is identical to the trough part 40, except the modified trough part 40' includes modified trough sections 41' and 42'. The modified trough sections 41' and 42' are identical to the trough sections 41 and 42, except the dimension D1 is set to overlap 75% of the heat transfer tubes disposed in the tier at inner ends of the trough sections 41' and 42'. Thus, each of the trough sections 41' includes a bottom wall portion 41*a*' and a pair of side wall portions 41*b*'. Similarly, each of the trough sections 42' includes a bottom wall portion 42*a*' and a pair of side wall portions 42*b*'. The side wall portions 41*b*' and 42*b*' have different heights depending on their location. The side wall portions 41*b*' and 42*b*' of the respective trough sections are mirrors images of each other, except for their heights in certain locations. Other than different heights (in some cases) and being mirror images of each other, the side wall portions 41*b*' and 42*b*' are identical to each other, and thus, will be given the same reference numerals for the sake of convenience.

Second Embodiment

Figure 17:
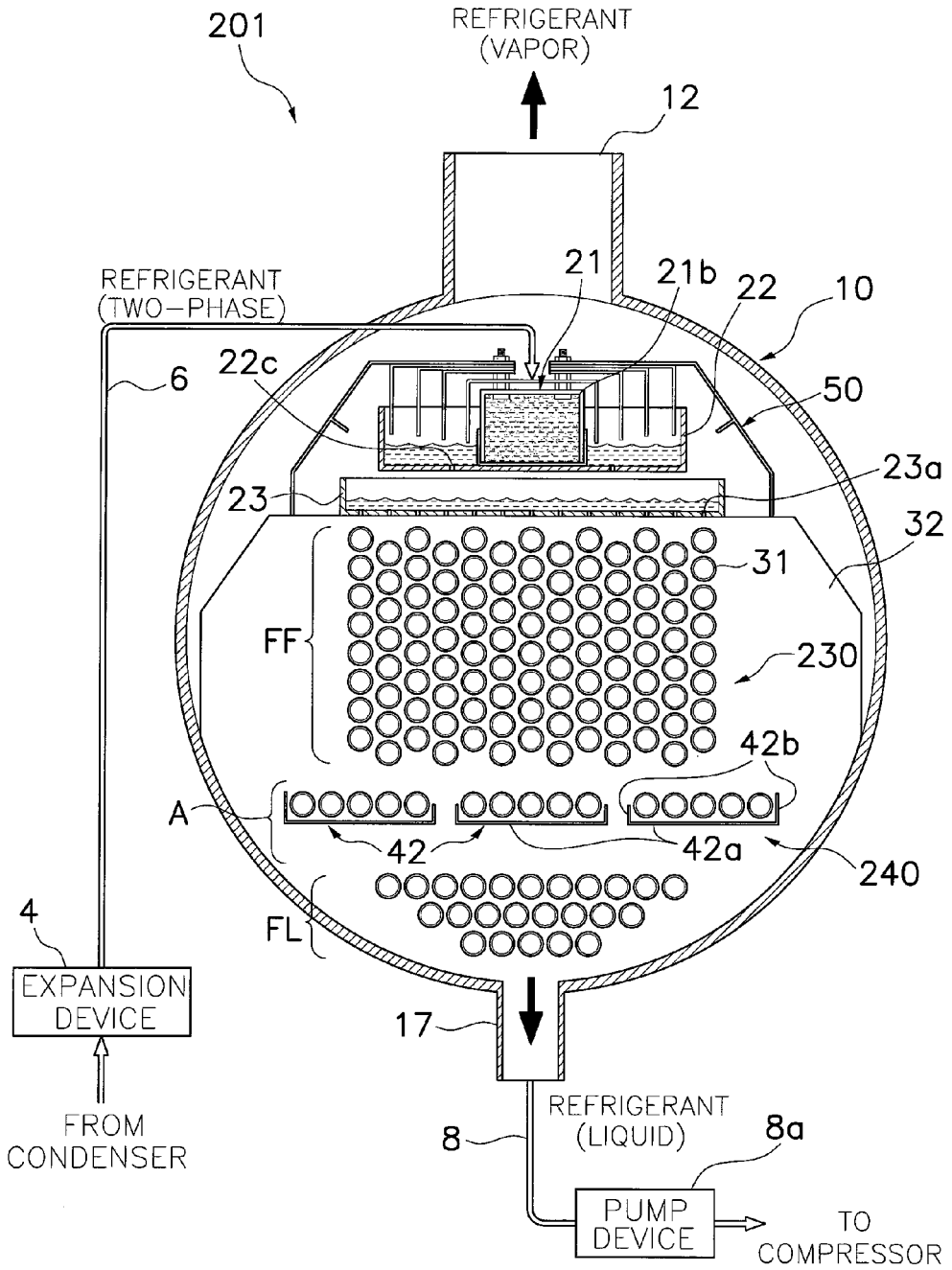
FIG. 17 is a simplified transverse cross sectional view of the heat exchanger illustrating an arrangement of a tube bundle and a trough part according to a second embodiment of the present invention.

Referring now to FIG. 17, an evaporator 201 in accordance with a second embodiment will now be explained. This second embodiment is identical to the first embodiment, except this second embodiment includes a modified trough part 240. Therefore, the descriptions and illustrations of the first embodiment also apply to this second embodiment, except as discussed and illustrated herein. In view of the similarity between the second embodiment and the first embodiment, the parts of the second embodiment that are identical to the parts of first embodiment will be given the same reference numerals as the parts of the first embodiment. Moreover, the descriptions of the parts of the second embodiment that are identical to the parts of the first embodiment may be omitted for the sake of brevity. As just mentioned, the evaporator 201 in accordance with this second embodiment is identical to the evaporator 1 of the first embodiment, except the evaporator 201 includes a modified trough part 240. Specifically, the modified trough part 240 includes the trough sections 42, but the trough sections 41 from the first embodiment are omitted. The heat transfer tubes 31 in the trough sections 41 are also eliminated to form a modified tube bundle 230. Otherwise, the tube bundle 230 (heat transferring unit) is identical to the tube bundle 30.

Other than the above mentioned differences, this second embodiment is identical to the first embodiment. Therefore, in this second embodiment, the heat transfer tubes 31 in the accumulating region A are arranged in a (single) horizontal row when viewed along the longitudinal center axis C of the shell 10, and the trough part 240 includes a plurality of laterally arranged trough sections 42 disposed below the horizontal row of the heat transfer tubes 31 in the accumulating region A as viewed along the longitudinal center axis C. Moreover, like the first embodiment, each trough section 42 includes a bottom wall portion 42*a* and a pair of side wall portions 42*b*, with two of the side wall portions 42*b* forming the outermost lateral ends of the trough part 240 and a remaining number of the side wall portions 42*b* forming inner side wall portions. Like the first embodiment, the inner side wall portions 42*b* have vertical heights smaller than the two of the side wall portions 42*b* forming the outermost lateral ends of the trough part 240. Also, like the first embodiment, the inner side wall portions 42*b* extend vertically upward from the bottom wall portions to positions overlapping at least 50% of the heat transfer tubes 31 in the horizontal row. Furthermore, like the first embodiment, an outermost one of the heat transfer tubes 31 in the accumulating region A is positioned outwardly of an outermost one of the columns of the heat transfer tubes 31 in the falling film region FF with respect to a transverse direction when viewed along the longitudinal center axis C of the shell 10.

Modification of Second Embodiment

Figure 18:
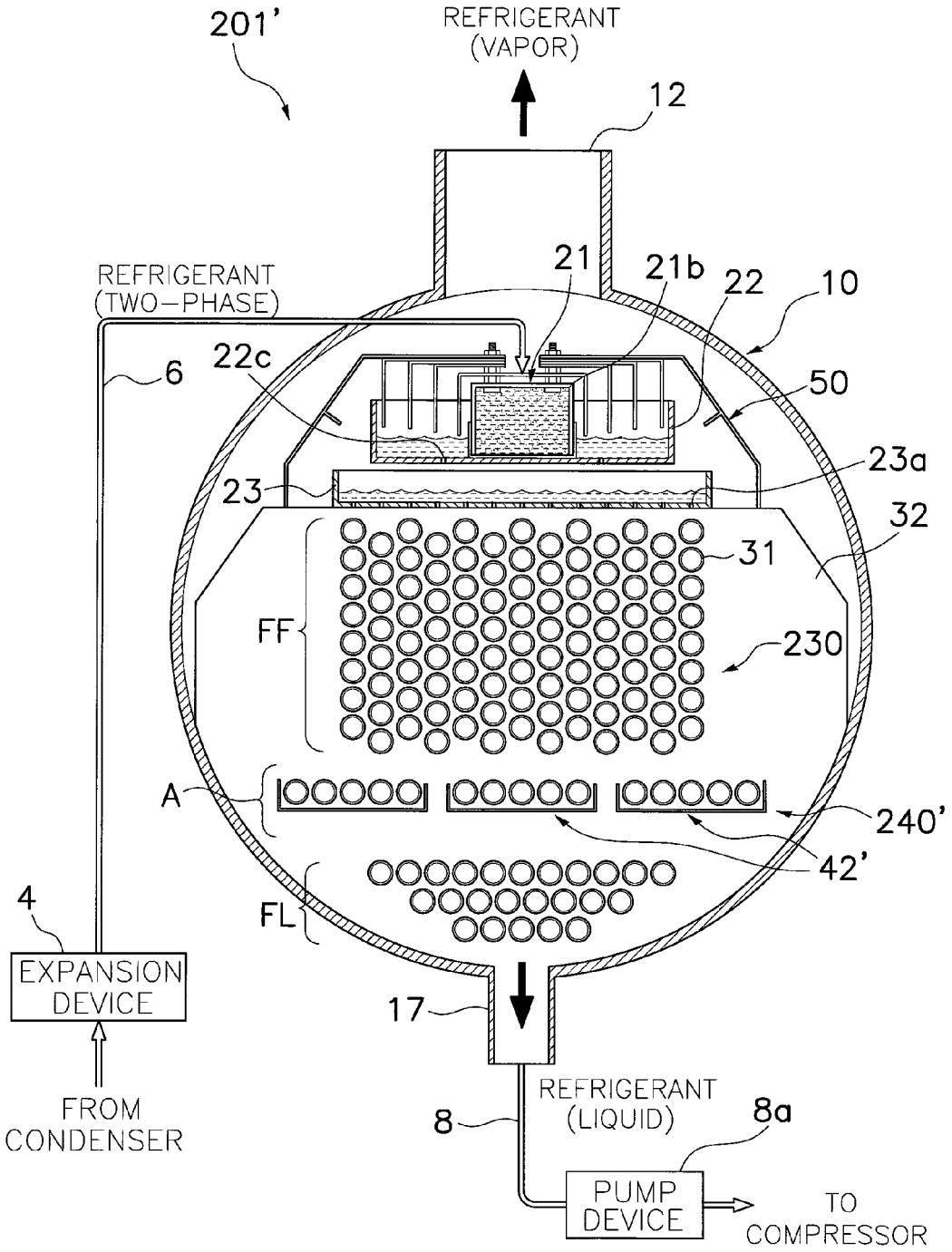
FIG. 18 is a simplified transverse cross sectional view of the heat exchanger illustrating a modified example for an arrangement of a tube bundle and a trough part according to the second embodiment of the present invention.

Referring now to FIG. 18, an evaporator 201' is illustrated in accordance with a modification of the second embodiment. The evaporator 201' is identical to the evaporator 201, except the evaporator includes a modified trough part 240'. In view of the similarity between this modification of the second embodiment and the second embodiment, the parts of this modification of the second embodiment that are identical to the parts of other embodiments will be given the same reference numerals as the parts of the other embodiments. Moreover, the descriptions of the parts of this modification of the second embodiment that are identical to the parts of the other embodiments may be omitted for the sake of brevity. Moreover, it will be apparent to those skilled in the art from this disclosure that the descriptions and illustrations of the preceding second embodiment also apply to this modification of the second embodiment, except as explained and illustrated herein.

The modified trough part 240' is identical to the trough part 240, except the modified trough part 240' includes modified trough sections 42' identical to the modified trough sections 42' of the modification of the first embodiment. Thus, the modified trough sections 42' are identical to the trough sections 42, except the dimension D1 is set to overlap 75% of the heat transfer tubes disposed in the tier.

Third Embodiment

Figure 19:
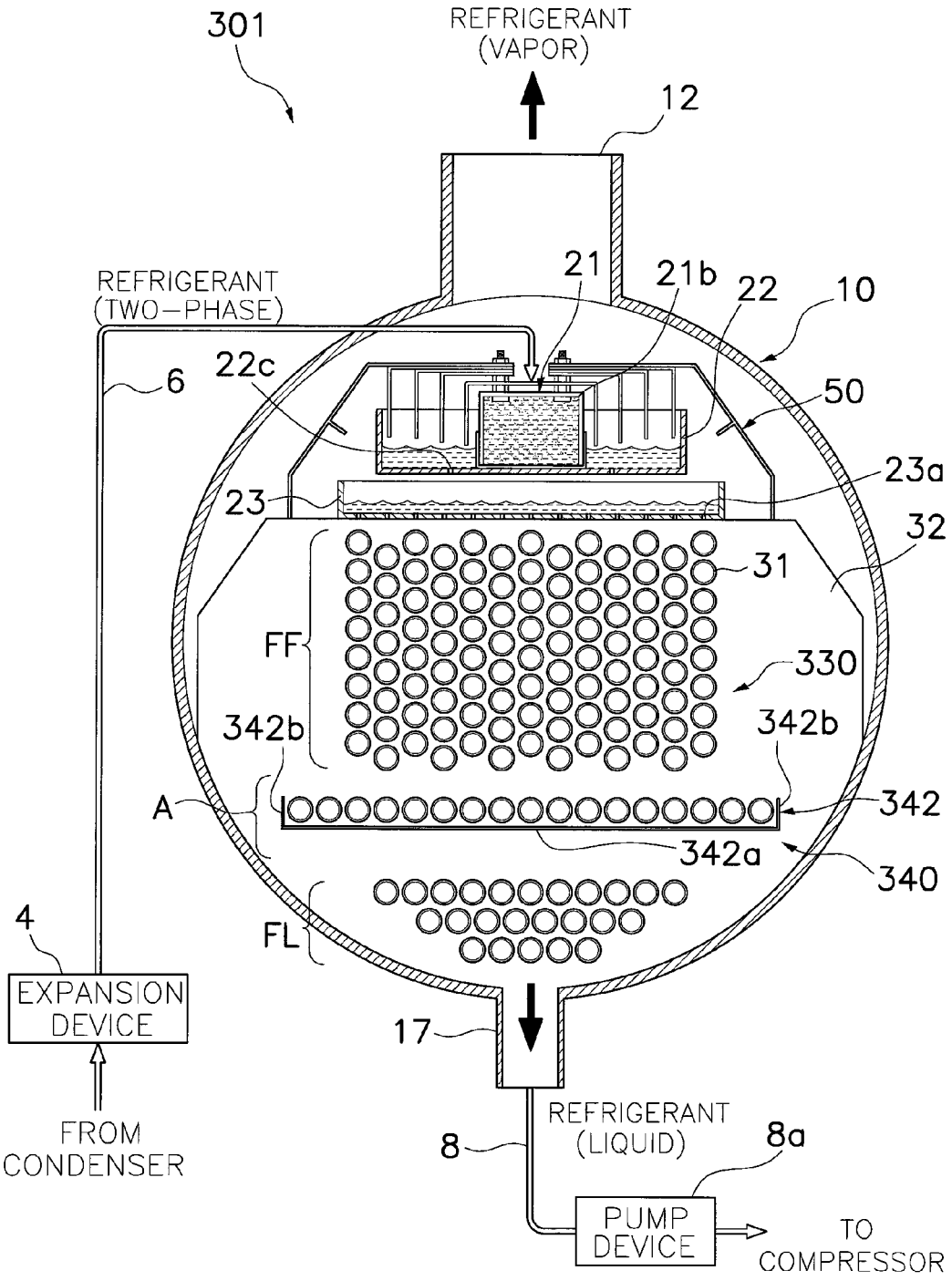
FIG. 19 is a simplified transverse cross sectional view of the heat exchanger illustrating an arrangement of a tube bundle and a trough part according to a third embodiment of the present invention.

Referring now to FIG. 19, an evaporator 301 in accordance with a third embodiment will now be explained. This third embodiment is identical to the first embodiment, except this third embodiment includes a modified trough part 340. Therefore, the descriptions and illustrations of the first embodiment also apply to this third embodiment, except as discussed and illustrated herein. In view of the similarity between the third embodiment and the first embodiment, the parts of the sixth embodiment that are identical to the parts of the first embodiment will be given the same reference numerals. Moreover, the descriptions of the parts of the third embodiment that are identical to the parts of the other embodiments may be omitted for the sake of brevity. As just mentioned, the evaporator 301 in accordance with this third embodiment is identical to the evaporator 1 of the first embodiment, except the evaporator 301 includes a modified trough part 340. Specifically, the modified trough part 340 includes a single trough section 342 in place of the trough sections 41 and 42 of the first embodiment. Due to the configuration of the trough section 342, a modified tube bundle 330 is formed. Otherwise, the tube bundle 330 (heat transferring unit) is identical to the tube bundle 30.

The trough section 342 is corresponds generally in size, shape and location to the trough sections 41 so that all of the refrigerant tubes 31 of a single tier can be disposed therein. Preferably, the trough part 342 includes a bottom wall 342*a* and a pair of side walls 342*b*. The side walls 342*b* preferably overlap 100% of the tier of heat transfer tubes 31 disposed therein. Other than the above mentioned differences, this third embodiment is identical to the first embodiment.

Fourth Embodiment

Figure 20:
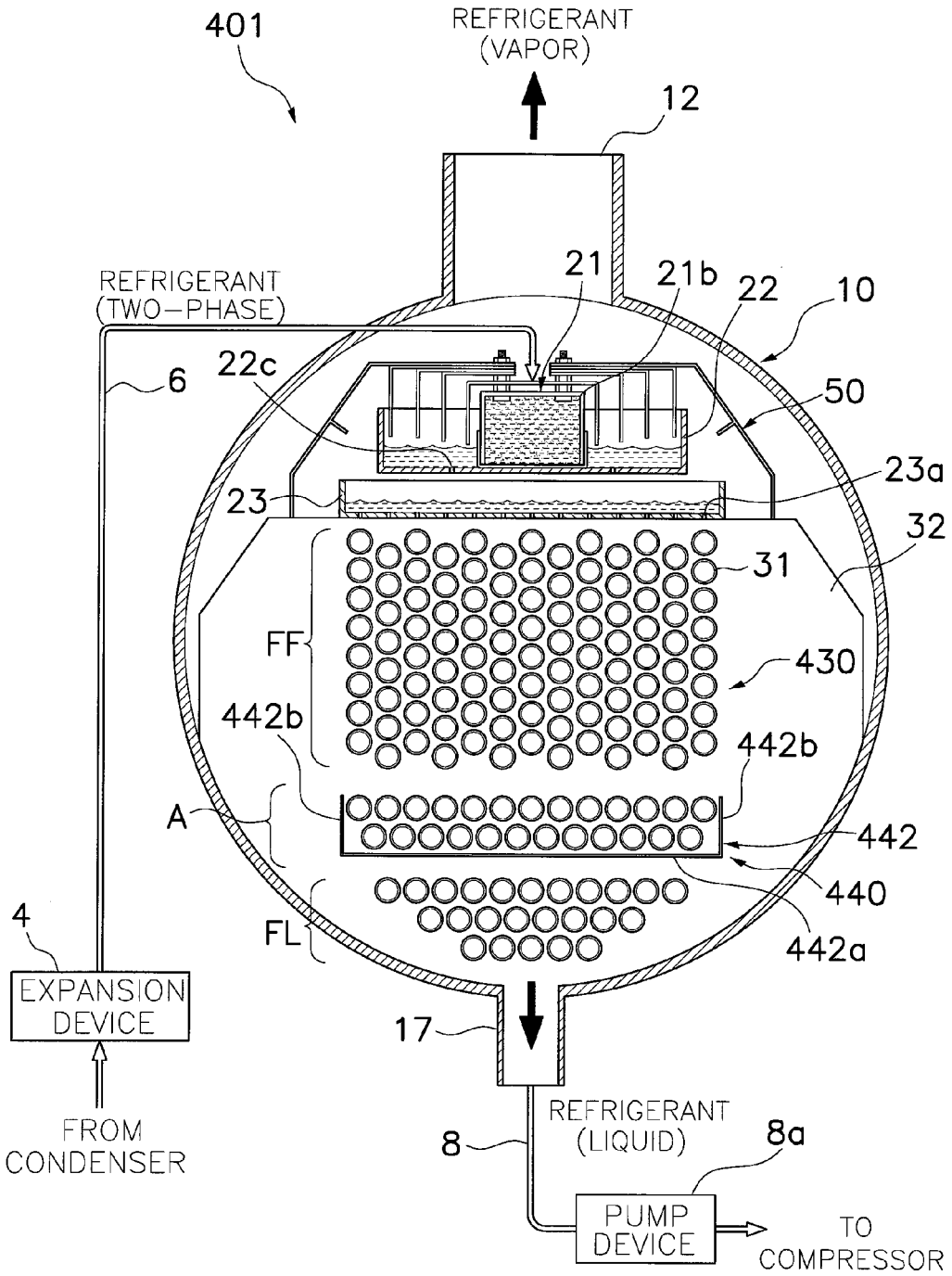
FIG. 20 is a simplified transverse cross sectional view of the heat exchanger illustrating an arrangement of a tube bundle and a trough part according to a fourth embodiment of the present invention.

Referring now to FIG. 20, an evaporator 401 in accordance with a fourth embodiment will now be explained. This fourth embodiment is identical to the first embodiment, except this fourth embodiment includes a modified trough part 440. Therefore, the descriptions and illustrations of the first embodiment also apply to this fourth embodiment, except as discussed and illustrated herein. In view of the similarity between the fourth embodiment and the first embodiment, the parts of the fourth embodiment that are identical to the parts of the first embodiment will be given the same reference numerals. Moreover, the descriptions of the parts of the fourth embodiment that are identical to the parts of the other embodiments may be omitted for the sake of brevity. As just mentioned, the evaporator 401 in accordance with this fourth embodiment is identical to the evaporator 1 of the first embodiment, except the evaporator 401 includes a modified trough part 440. Specifically, the modified trough part 440 includes a single trough section 442 in place of the trough sections 41 and 42 of the first embodiment. Due to the configuration of the trough section 442, a modified tube bundle 430 is formed. Otherwise, the tube bundle 430 (heat transferring unit) is identical to the tube bundle 30.

The trough section 442 is deeper than the trough sections 41 and 42 (about twice as deep) so that two tiers of the refrigerant tubes 31 can be disposed therein. Preferably, the trough part 442 includes a bottom wall 442*a* and a pair of side walls 442*b*. The side walls 442*b* preferably overlap 100% of the two tiers of heat transfer tubes 31 disposed therein. Other than the above mentioned differences, this fourth embodiment is identical to the first embodiment.

Fifth Embodiment

Figure 21:
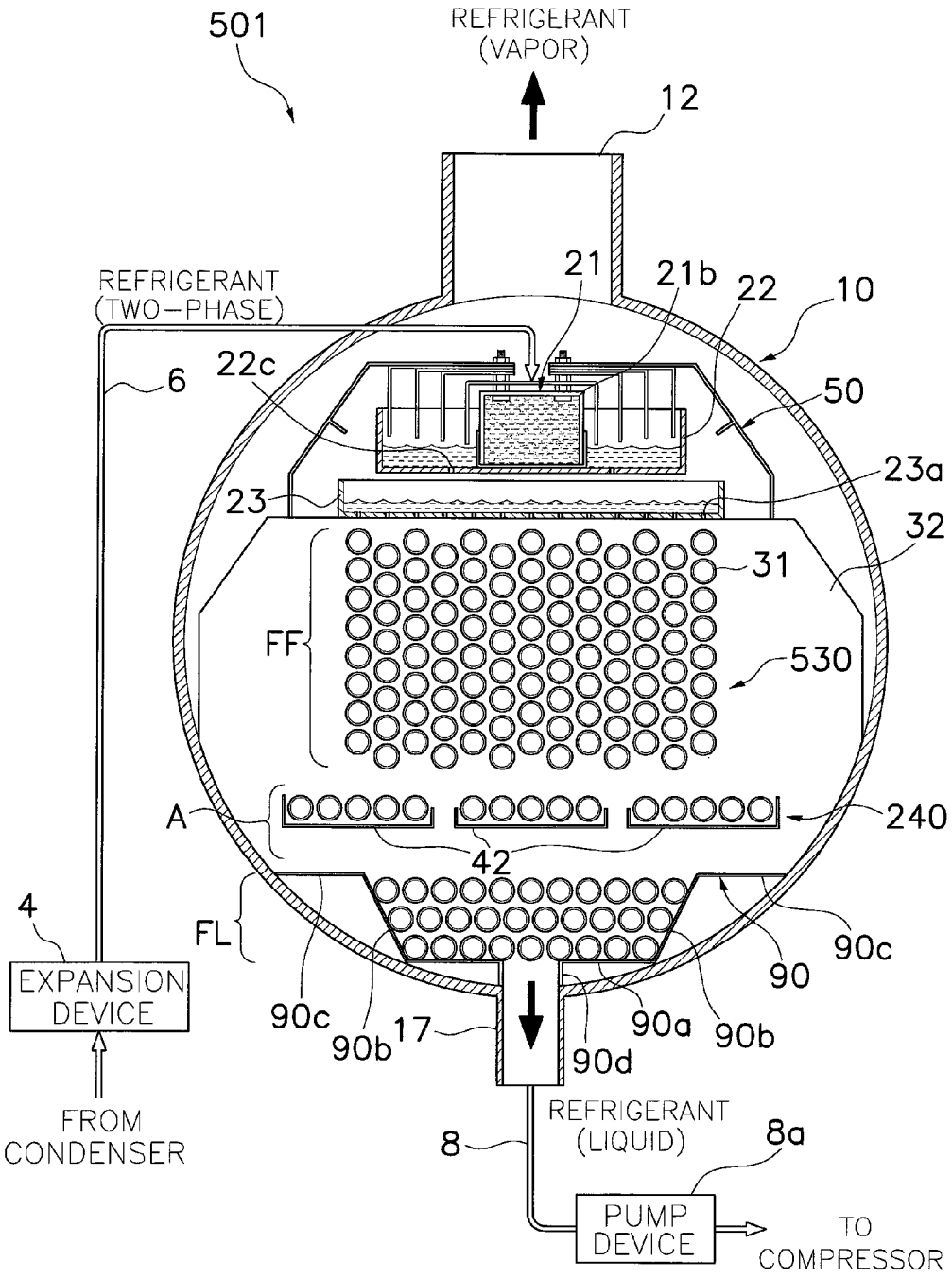
FIG. 21 is a simplified transverse cross sectional view of the heat exchanger illustrating an arrangement of a tube bundle, a trough part and a flooded section trough part according to a fifth embodiment of the present invention.

Referring now to FIG. 21, an evaporator 501 in accordance with a fifth embodiment will now be explained. This fifth embodiment is identical to the second embodiment, except this fifth embodiment includes a flooded region tray 90 disposed below the heat transfer tubes 31 disposed in the flooded region FL below the accumulating region A. The flooded region tray 90 has a size and shape corresponding to an overall size and shape of the heat transfer tubes 31 of the flooded region FL below the accumulating region A. Due to the presence of the flooded section tray 90, the fluid conduit 8 is communicated to the channel of the tray 90 where the heat transfer tubes 31 are disposed therein. Therefore, the descriptions and illustrations of the second embodiment also apply to this fifth embodiment, except as discussed and illustrated herein. In view of the similarity between the fifth embodiment and the preceding embodiments, the parts of the fifth embodiment that are identical to the parts of other embodiments will be given the same reference numerals as the parts of the other embodiments. Moreover, the descriptions of the parts of the fifth embodiment that are identical to the parts of the other embodiments may be omitted for the sake of brevity.

The evaporator 501 in accordance with this fifth embodiment is identical to the evaporator 201 of the second embodiment, except the evaporator 501 includes the flooded section tray 90. Specifically, the flooded section tray 90 is disposed below the group of heat transfer tubes 31 that are disposed in the flooded region FL. The flooded section tray 90 extends longitudinally along the center axis X along the length of the heat transfer tubes 31 like the trough sections 41 and 42. The flooded section tray 90 is preferably constructed of rigid material such as metal sheet or plate material that is bent, extruded or cast in the cross-sectional shape illustrated in FIG. 21. The flooded section tray 90 also preferably has a uniform cross-section along the entire longitudinal length thereof. Each of the vertical plates 32 preferably has an opening (not shown) so that refrigerant received in the flooded section tray 90 can flow longitudinally within the flooded section tray 90. The flooded section tray 90 basically includes a bottom wall portion 90*a*, a pair of side wall portions 90*b*, a pair of lateral end portions 90*c*, and a fluid communication tube portion 90*d* extending downwardly from the bottom wall 90*a* to the bottom outlet pipe 17. Thus, the channel of the flooded section tray 90 communicates with the fluid conduit 8. In this embodiment, the bottom wall portion 90*a* and the pair of side wall portions 90*b* have a size and shape corresponding to the overall size and shape of the group of heat transfer tubes 31 disposed therein. In this embodiment, the bottom wall portion 90*a* and the pair of side wall portions 90*b* have a trapezoidal shape. The lateral end portions 90*c* extend generally horizontally. In the illustrated embodiment, the heat transfer tubes 31 in the flooded region are configured slightly differently than the preceding embodiments to minimize a volume of the flooded region FL, and the flooded region tray 90 has the same size and shape. Otherwise, the tube bundle 530 (heat transferring unit) is identical to the tube bundle 230.

Modification of Fifth Embodiment

Figure 22:
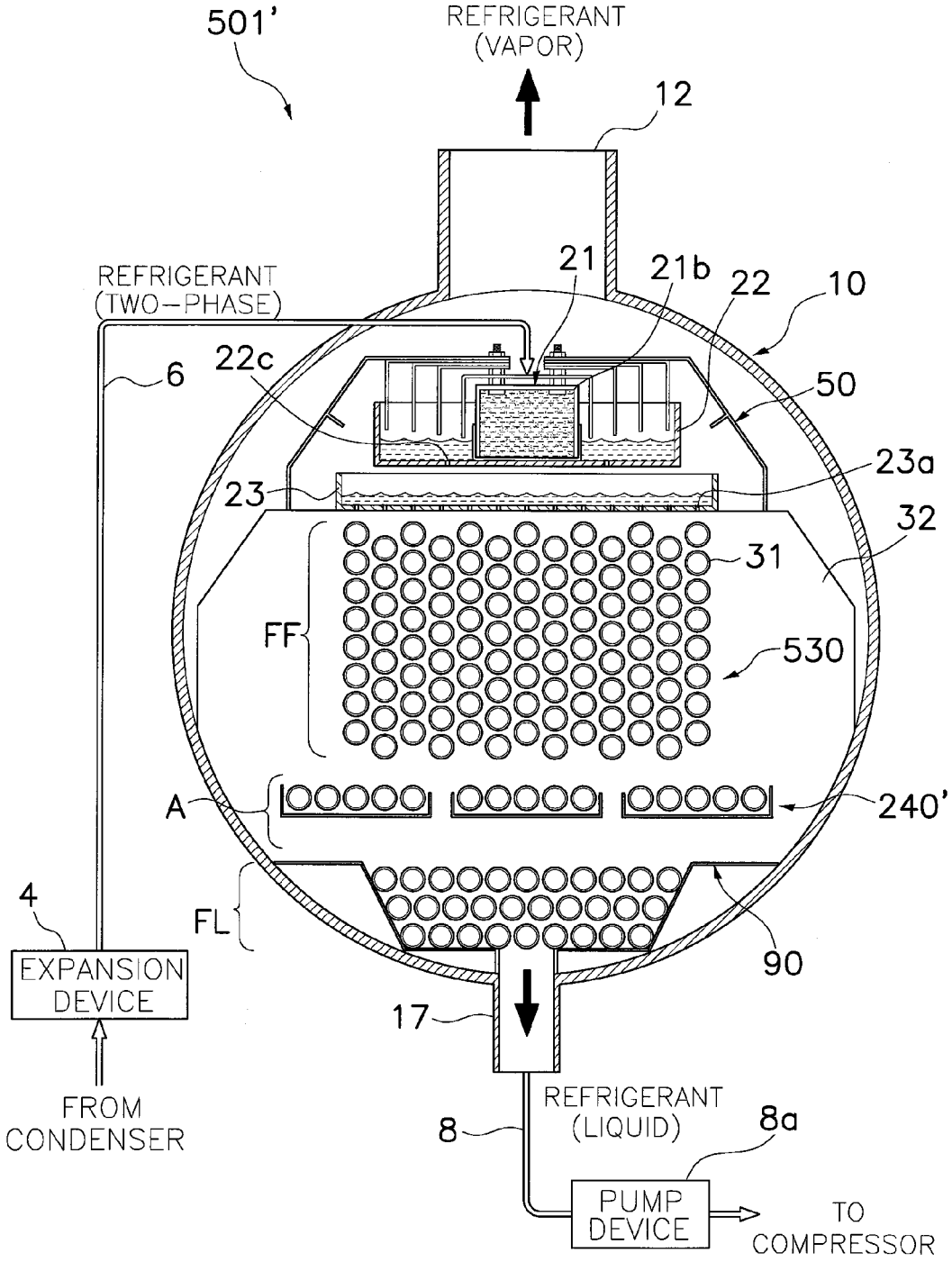
FIG. 22 is a simplified transverse cross sectional view of the heat exchanger illustrating a modified example for an arrangement of a tube bundle, a trough part and a flooded section trough part according to the fifth embodiment of the present invention.

Referring now to FIG. 22, an evaporator 501' is illustrated in accordance with a modification of the fifth embodiment. The evaporator 501' is identical to the evaporator 501, except the evaporator includes a modified trough part 240' like the modification of the second embodiment. In view of the similarity between this modification of the fifth embodiment and the fifth embodiment, the parts of this modification of the fifth embodiment that are identical to the parts of other embodiments will be given the same reference numerals as the parts of the other embodiments. Moreover, the descriptions of the parts of this modification of the fifth embodiment that are identical to the parts of the other embodiments may be omitted for the sake of brevity. Moreover, it will be apparent to those skilled in the art from this disclosure that the descriptions and illustrations of the preceding fifth embodiment also apply to this modification of the fifth embodiment, except as explained and illustrated herein.

The modified trough part 240' is disclosed in the modification of the second embodiment above, and thus, will not be repeated herein for the sake of brevity. Otherwise, this modification of the fifth embodiment is identical to the fifth embodiment.

Sixth Embodiment

Figure 23:
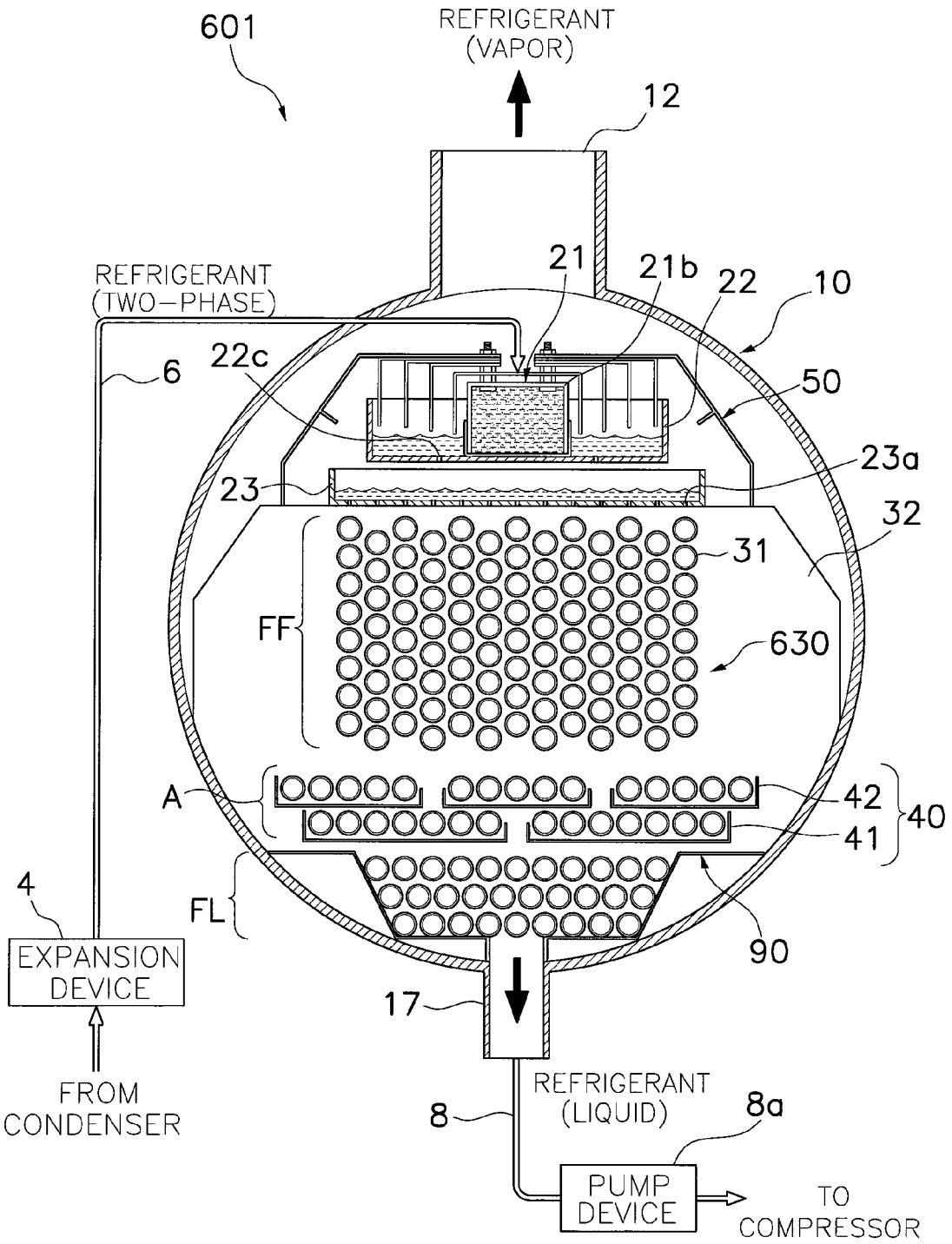
FIG. 23 is a simplified transverse cross sectional view of the heat exchanger illustrating an arrangement of a tube bundle, a trough part and a flooded section trough part according to a sixth embodiment of the present invention.

Referring now to FIG. 23, an evaporator 601 in accordance with a sixth embodiment will now be explained. This sixth embodiment is identical to the first embodiment, except this sixth embodiment includes the flooded region tray 90 (i.e., like the fifth embodiment) disposed below the heat transfer tubes 31 disposed in the flooded region FL below the accumulating region A. The flooded region tray 90 has a size and shape corresponding to an overall size and shape of the heat transfer tubes 31 of the flooded region FL below the accumulating region A. Therefore, the descriptions and illustrations of the first embodiment also apply to this sixth embodiment, except as discussed and illustrated herein. In view of the similarity between the sixth embodiment and the preceding embodiments, the parts of the sixth embodiment that are identical to the parts of other embodiments will be given the same reference numerals as the parts of the other embodiments. Moreover, the descriptions of the parts of the sixth embodiment that are identical to the parts of the other embodiments may be omitted for the sake of brevity.

The evaporator 601 in accordance with this sixth embodiment is identical to the evaporator 1 of the first embodiment, except the evaporator 601 includes the flooded section tray 90 (of the fifth embodiment). The flooded section tray 90 is already described with reference to the fifth embodiment, and thus, the descriptions will not be repeated herein for the sake of brevity. In the illustrated embodiment, the heat transfer tubes 31 in the flooded region are configured slightly differently than the preceding embodiments (configured like the fifth embodiment) to minimize a volume of the flooded region FL, and the flooded region tray 90 has the same size and shape. Otherwise, the tube bundle 630 (heat transferring unit) is identical to the tube bundle 30.

Modification of Sixth Embodiment

Figure 24:
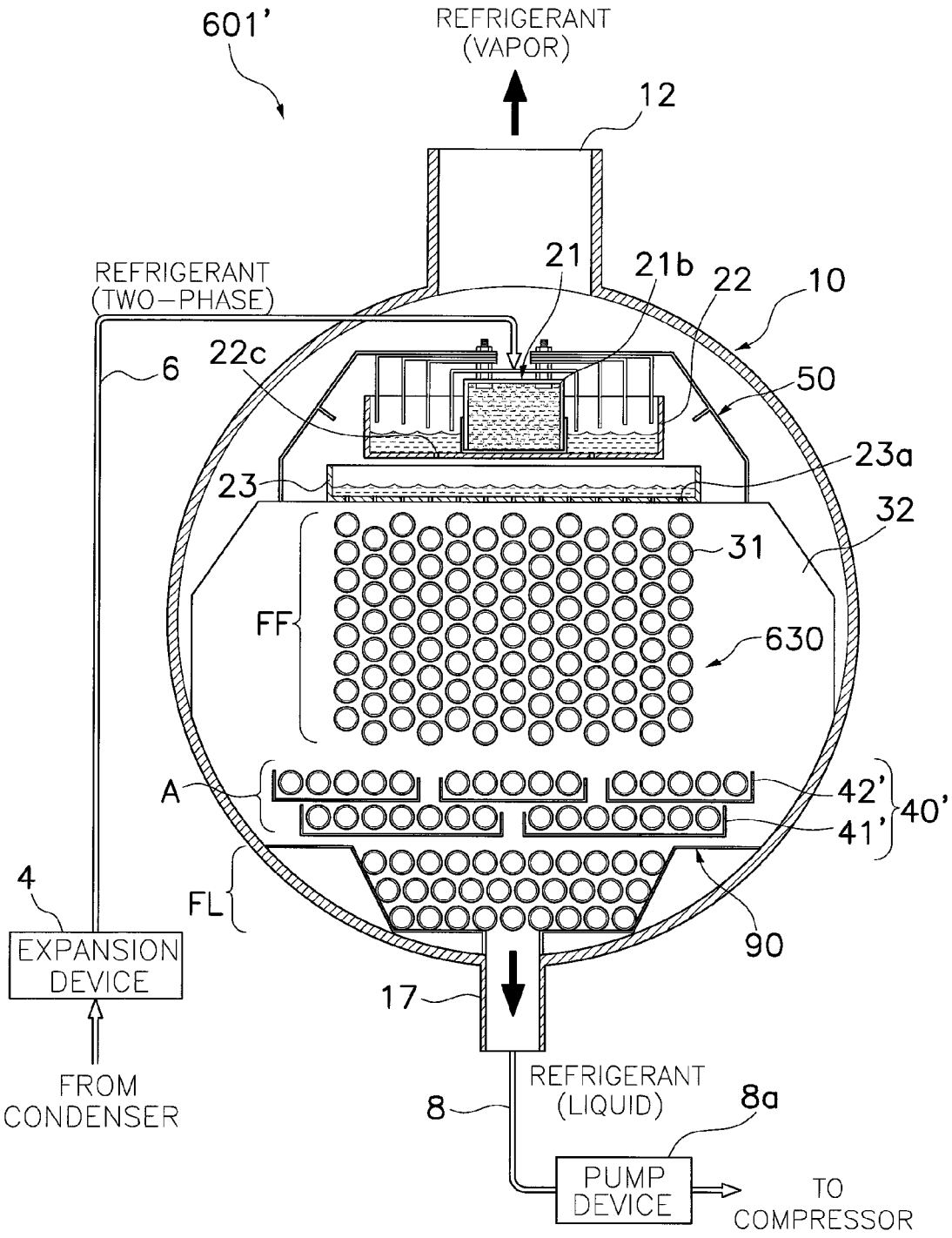
FIG. 24 is a simplified transverse cross sectional view of the heat exchanger illustrating a modified example for an arrangement of a tube bundle, a trough part and a flooded section trough part according to the sixth embodiment of the present invention.

Referring now to FIG. 24, an evaporator 601' is illustrated in accordance with a modification of the sixth embodiment. The evaporator 601' is identical to the evaporator 601, except the evaporator includes a modified trough part 40' like the modification of the first embodiment. In view of the similarity between this modification of the sixth embodiment and the sixth embodiment, the parts of this modification of the sixth embodiment that are identical to the parts of other embodiments will be given the same reference numerals as the parts of the other embodiments. Moreover, the descriptions of the parts of this modification of the sixth embodiment that are identical to the parts of the other embodiments may be omitted for the sake of brevity. Moreover, it will be apparent to those skilled in the art from this disclosure that the descriptions and illustrations of the preceding sixth embodiment also apply to this modification of the sixth embodiment, except as explained and illustrated herein.

The modified trough part 40' is disclosed in the modification of the first embodiment above, and thus, will not be repeated herein for the sake of brevity. Otherwise, this modification of the sixth embodiment is identical to the sixth embodiment.

Seventh Embodiment

Figure 25:
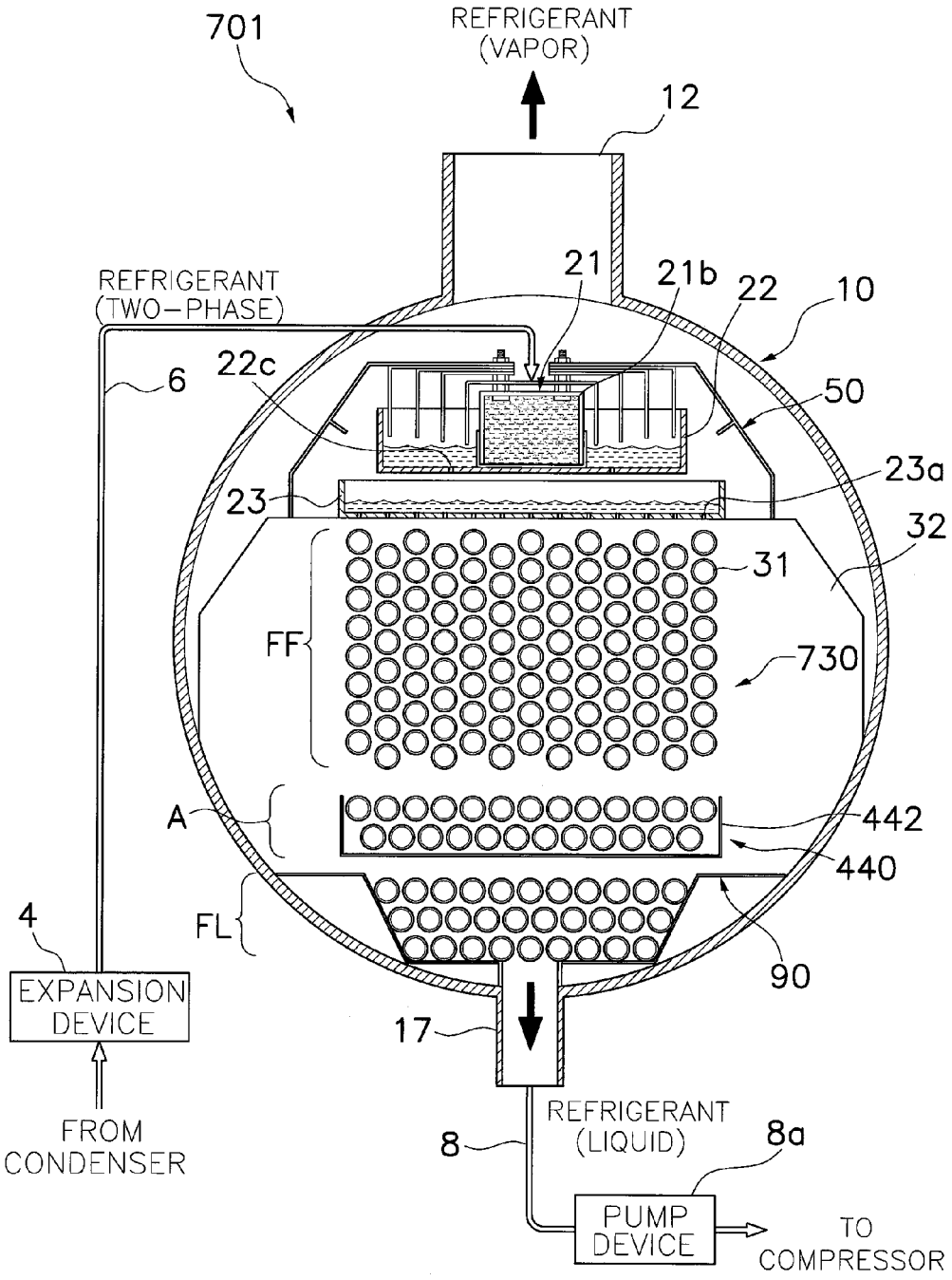
FIG. 25 is a simplified transverse cross sectional view of the heat exchanger illustrating an arrangement of a tube bundle, a trough part and a flooded section trough part according to a seventh embodiment of the present invention.

Referring now to FIG. 25, an evaporator 701 in accordance with a seventh embodiment will now be explained. This seventh embodiment is identical to the fourth embodiment, except this seventh embodiment includes the flooded region tray 90 (i.e., like the fifth embodiment) disposed below the heat transfer tubes 31 disposed in the flooded region FL below the accumulating region A. The flooded region tray 90 has a size and shape corresponding to an overall size and shape of the heat transfer tubes 31 of the flooded region FL below the accumulating region A. Therefore, the descriptions and illustrations of the fourth embodiment also apply to this seventh embodiment, except as discussed and illustrated herein. In view of the similarity between the seventh embodiment and the preceding embodiments, the parts of the seventh embodiment that are identical to the parts of other embodiments will be given the same reference numerals as the parts of the other embodiments. Moreover, the descriptions of the parts of the seventh embodiment that are identical to the parts of the other embodiments may be omitted for the sake of brevity.

The evaporator 701 in accordance with this seventh embodiment is identical to the evaporator 401 of the fourth embodiment, except the evaporator 701 includes the flooded section tray 90. In the illustrated embodiment, the heat transfer tubes 31 in the flooded region are configured slightly differently than the preceding embodiments (configured like the fifth embodiment) to minimize a volume of the flooded region FL, and the flooded region tray 90 has the same size and shape. Otherwise, the tube bundle 730 (heat transferring unit) is identical to the tube bundle 430.

Eighth Embodiment

Figure 26:
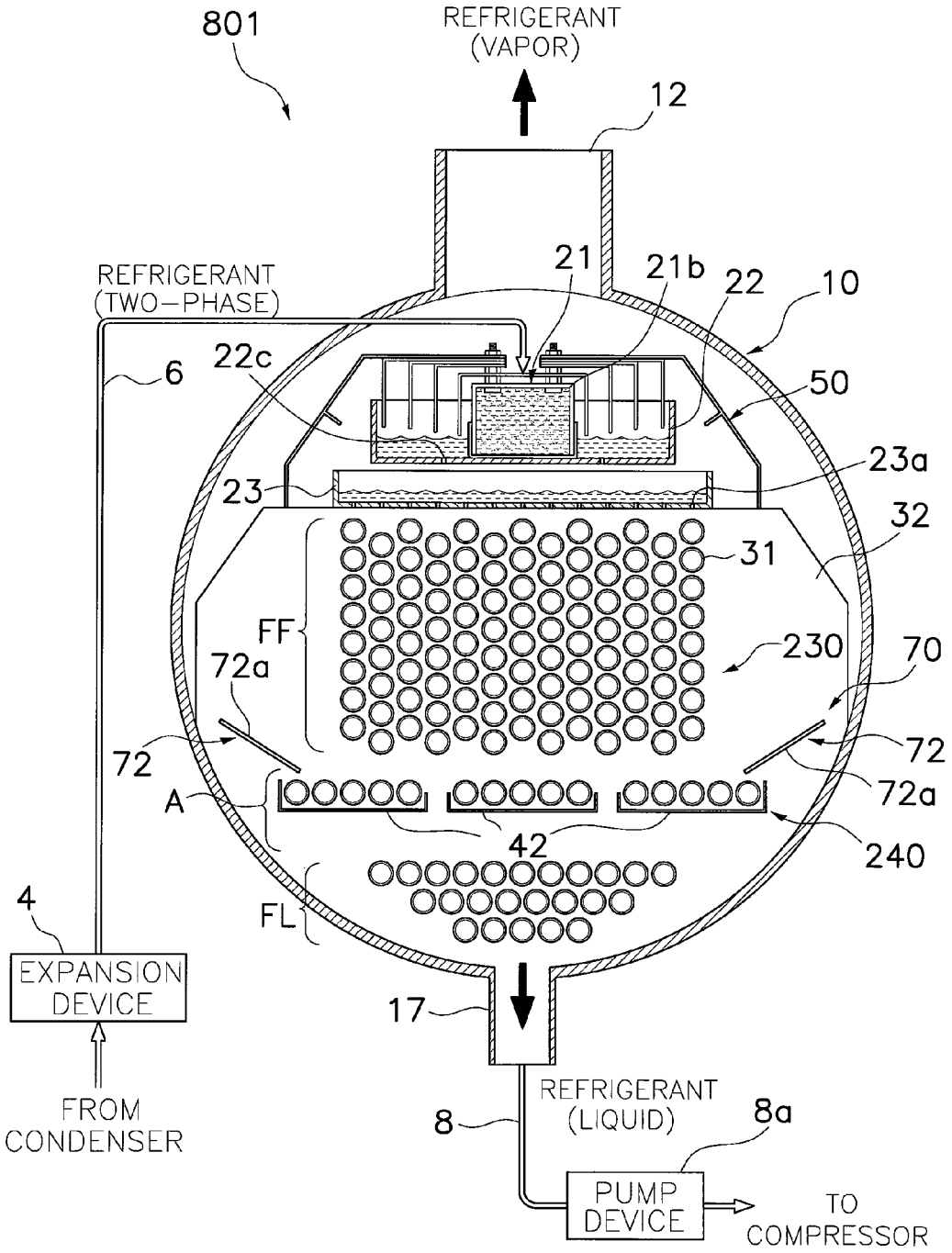
FIG. 26 is a simplified transverse cross sectional view of the heat exchanger illustrating an arrangement of a tube bundle, a trough part and a guide part according to an eighth embodiment of the present invention.

Referring now to FIG. 26, an evaporator 801 in accordance with a eighth embodiment will now be explained. This eighth embodiment is identical to the second embodiment, except this eighth embodiment includes a guide part 70 arranged to guide scattered refrigerant back toward the heat transfer tubes 31 above the trough part 240. Therefore, the descriptions and illustrations of the second embodiment also apply to this eighth embodiment, except as discussed and illustrated herein. In view of the similarity between the eighth embodiment and the preceding embodiments, the parts of the eighth embodiment that are identical to the parts of other embodiments will be given the same reference numerals as the parts of the other embodiments. Moreover, the descriptions of the parts of the eighth embodiment that are identical to the parts of the other embodiments may be omitted for the sake of brevity.

The evaporator 801 in accordance with this eighth embodiment is identical to the evaporator 201 of the second embodiment, except the evaporator 801 includes the guide part 70. Specifically, the guide part 70 basically includes a pair of lateral side portions 72 extending upwardly and laterally outwardly from the tube bundle 230 at a vertical position at opposite lateral sides of an upper end of the trough part 240. In any case, the guide part 70 includes at least one lateral side portion 72 extending upwardly and laterally outwardly from the tube bundle 230 at a vertical position at an upper end of the trough part 240. Each lateral side portion 72 is formed of a plurality of separate sections that are welded to vertical plates 32 as best understood from FIGS. 4-6.

Each lateral side portion 72 of the guide part 70 includes an inclined section 72*a* that is inclined between 10 degrees and 45 degrees relative to a horizontal plane P passing through the longitudinal center axis C of the shell 10. More preferably, each inclined section 72*a* is inclined between 30 degrees and 45 degrees relative to the horizontal plane P. In the illustrated embodiment, each inclined section 72*a* is inclined about 40 degrees relative to the horizontal plane P. As seen in FIG. 7, the lateral side portions 72 and the inclined sections 72*a* are identical to each other, except their orientations are mirror images of each other. In the illustrated embodiment, each of the lateral side portions 72 consists only of one of the inclined sections 72*a*. However, it will be apparent to those skilled in the art from this disclosure that each of the lateral side portions 72 can include an additional section or additional sections if needed and/or desired.

Modification of Eighth Embodiment

Figure 27:
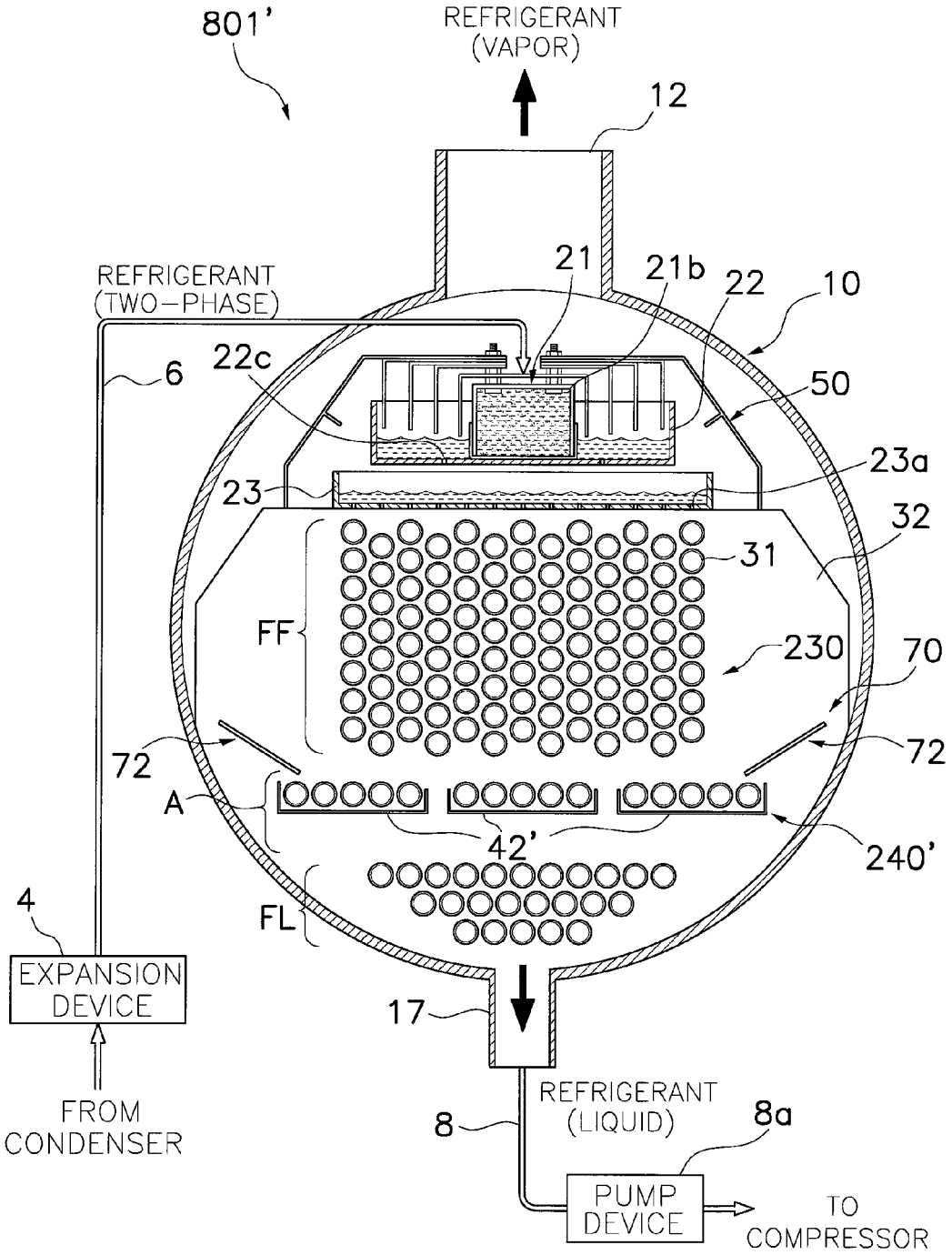
FIG. 27 is a simplified transverse cross sectional view of the heat exchanger illustrating a modified example for an arrangement of a tube bundle, a trough part and a guide part according to the eighth embodiment of the present invention.

Referring now to FIG. 27, an evaporator 801' is illustrated in accordance with a modification of the eighth embodiment. The evaporator 801' is identical to the evaporator 801, except the evaporator includes a modified trough part 240' like the modification of the second embodiment. In view of the similarity between this modification of the eighth embodiment and the eighth embodiment, the parts of this modification of the eighth embodiment that are identical to the parts of other embodiments will be given the same reference numerals as the parts of the other embodiments. Moreover, the descriptions of the parts of this modification of the eighth embodiment that are identical to the parts of the other embodiments may be omitted for the sake of brevity. Moreover, it will be apparent to those skilled in the art from this disclosure that the descriptions and illustrations of the preceding eighth embodiment also apply to this modification of the eighth embodiment, except as explained and illustrated herein.

The modified trough part 240' is disclosed in the modification of the second embodiment above, and thus, will not be repeated herein for the sake of brevity. Otherwise, this modification of the eighth embodiment is identical to the eighth embodiment.

Ninth Embodiment

Figure 28:
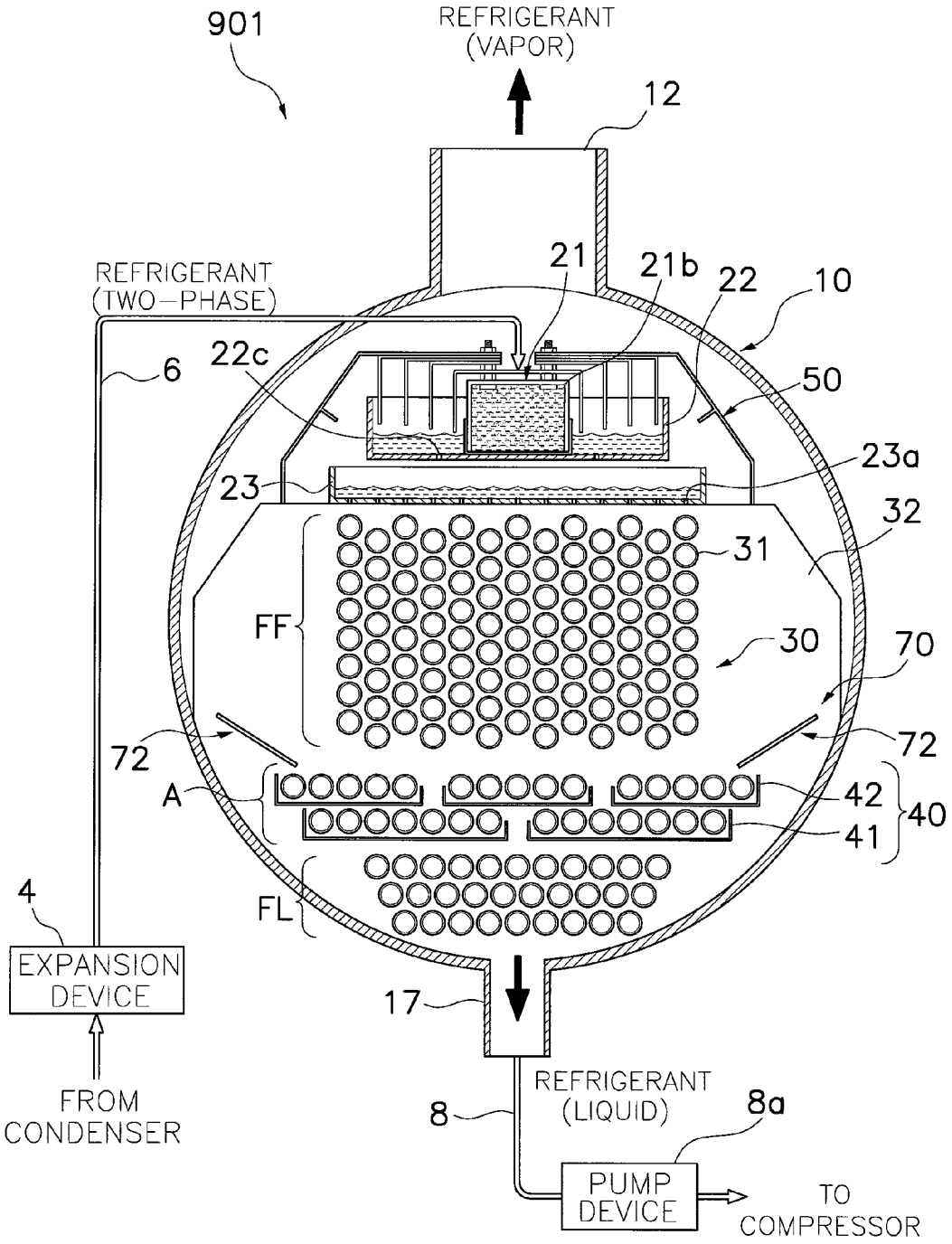
FIG. 28 is a simplified transverse cross sectional view of the heat exchanger illustrating an arrangement of a tube bundle, a trough part and a guide part according to a ninth embodiment of the present invention.

Referring now to FIG. 28, an evaporator 901 in accordance with a ninth embodiment will now be explained. This ninth embodiment is identical to the first embodiment, except this ninth embodiment includes the guide part 70 (i.e., like the eighth embodiment). Therefore, the descriptions and illustrations of the first embodiment also apply to this ninth embodiment, except as discussed and illustrated herein. In view of the similarity between the ninth embodiment and the preceding embodiments, the parts of the ninth embodiment that are identical to the parts of other embodiments will be given the same reference numerals as the parts of the other embodiments. Moreover, the descriptions of the parts of the ninth embodiment that are identical to the parts of the other embodiments may be omitted for the sake of brevity.

The evaporator 901 in accordance with this ninth embodiment is identical to the evaporator 1 of the first embodiment, except the evaporator 901 includes the guide part 70 (of the eighth embodiment). The guide part 70 is already described with reference to the eighth embodiment, and thus, the descriptions will not be repeated herein for the sake of brevity.

Modification of Ninth Embodiment

Figure 29:
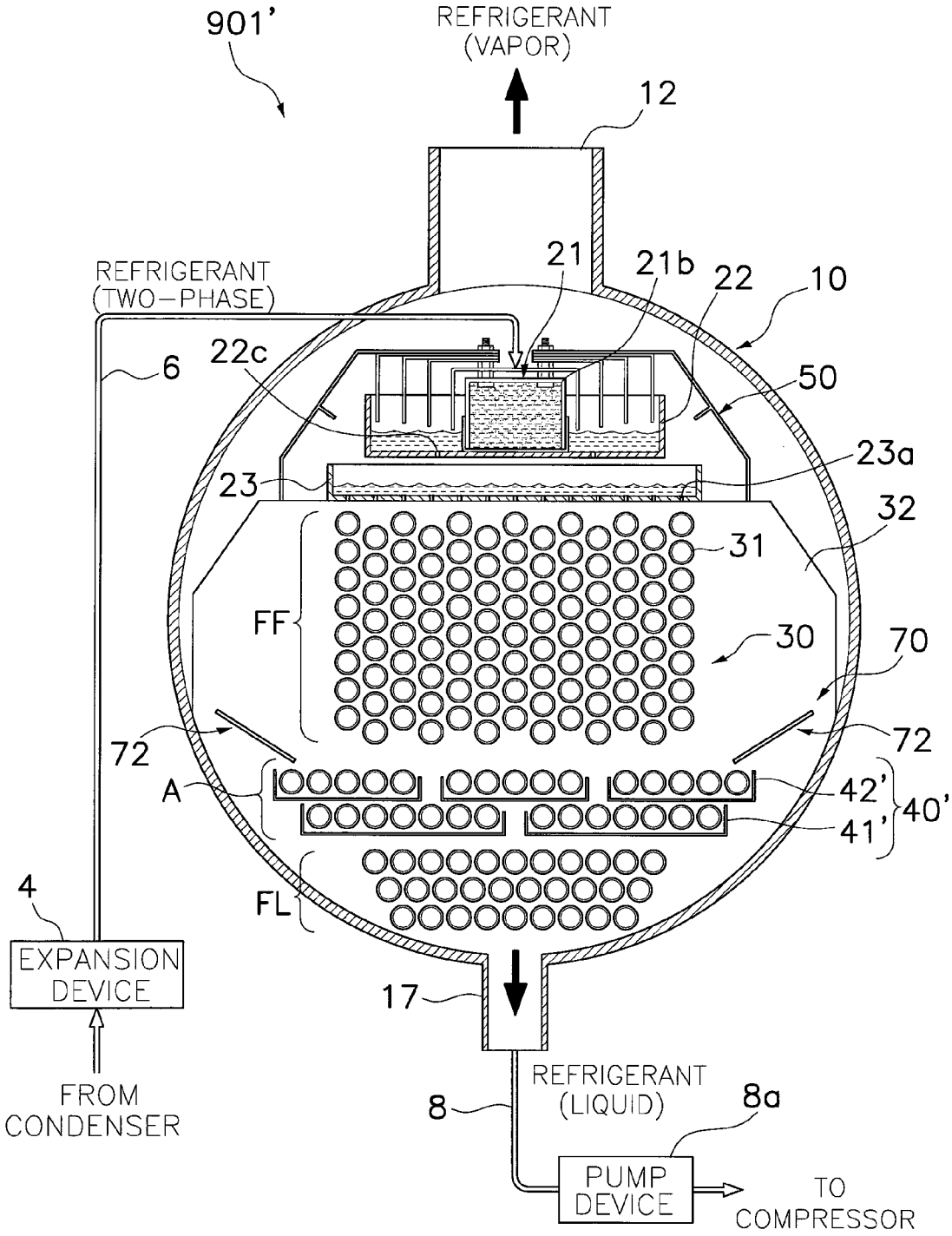
FIG. 29 is a simplified transverse cross sectional view of the heat exchanger illustrating a modified example for an arrangement of a tube bundle, a trough part and a guide part according to the ninth embodiment of the present invention.

Referring now to FIG. 29, an evaporator 901' is illustrated in accordance with a modification of the ninth embodiment. The evaporator 901' is identical to the evaporator 901, except the evaporator includes a modified trough part 40' like the modification of the first embodiment. In view of the similarity between this modification of the ninth embodiment and the ninth embodiment, the parts of this modification of the ninth embodiment that are identical to the parts of other embodiments will be given the same reference numerals as the parts of the other embodiments. Moreover, the descriptions of the parts of this modification of the ninth embodiment that are identical to the parts of the other embodiments may be omitted for the sake of brevity. Moreover, it will be apparent to those skilled in the art from this disclosure that the descriptions and illustrations of the preceding ninth embodiment also apply to this modification of the ninth embodiment, except as explained and illustrated herein.

The modified trough part 40' is disclosed in the modification of the first embodiment above, and thus, will not be repeated herein for the sake of brevity. Otherwise, this modification of the ninth embodiment is identical to the ninth embodiment.

Tenth Embodiment

Figure 30:
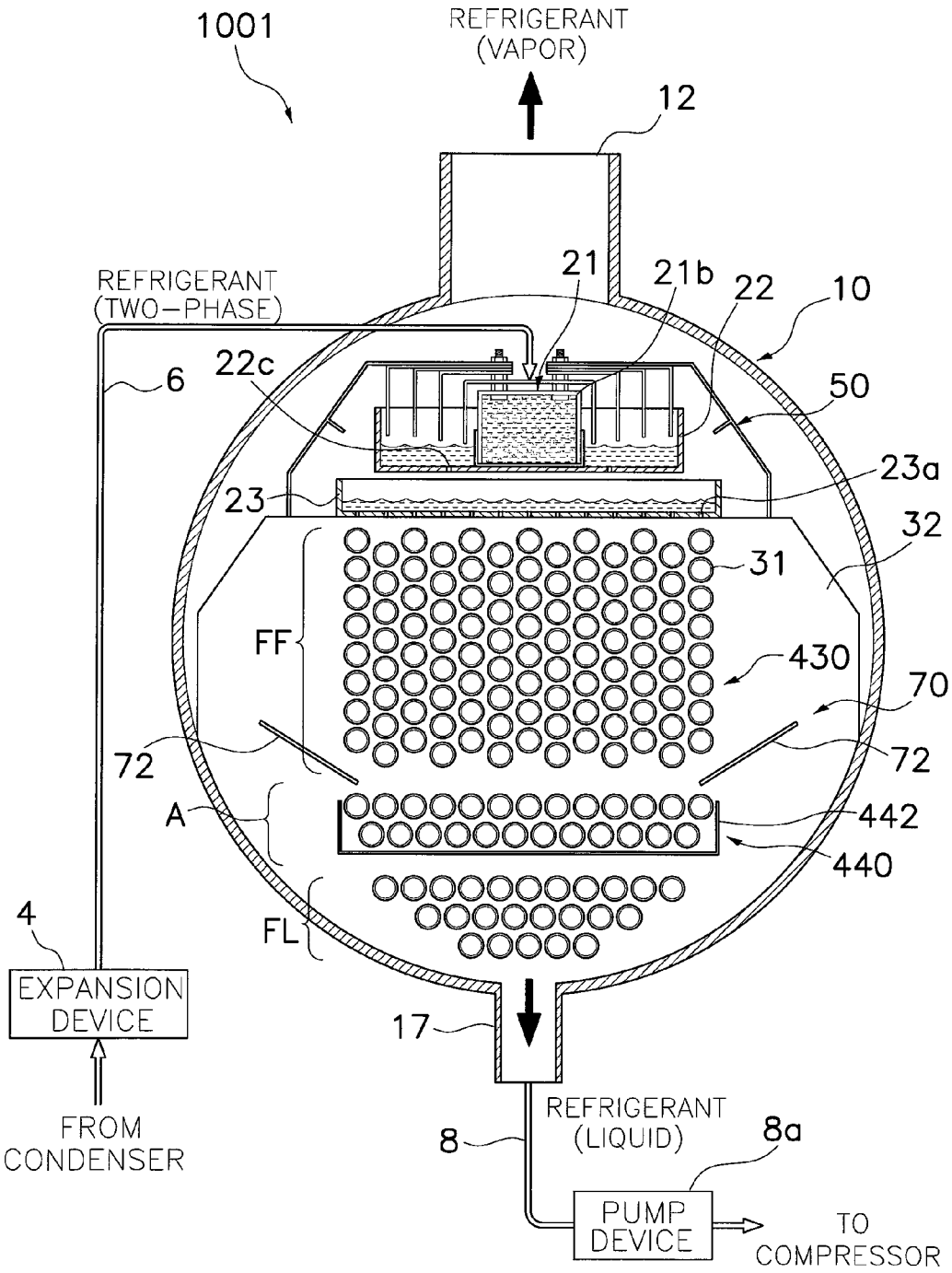
FIG. 30 is a simplified transverse cross sectional view of the heat exchanger illustrating an arrangement of a tube bundle, a trough part and a guide part according to a tenth embodiment of the present invention.

Referring now to FIG. 30, an evaporator 1001 in accordance with a tenth embodiment will now be explained. This tenth embodiment is identical to the fourth embodiment, except this tenth embodiment includes the guide part 70 (i.e., like the eighth embodiment). Therefore, the descriptions and illustrations of the fourth embodiment also apply to this tenth embodiment, except as discussed and illustrated herein. In view of the similarity between the tenth embodiment and the preceding embodiments, the parts of the tenth embodiment that are identical to the parts of other embodiments will be given the same reference numerals as the parts of the other embodiments. Moreover, the descriptions of the parts of the tenth embodiment that are identical to the parts of the other embodiments may be omitted for the sake of brevity.

The evaporator 1001 in accordance with this tenth embodiment is identical to the evaporator 401 of the fourth embodiment, except the evaporator 1001 includes the guide part 70 (of the eighth embodiment). The guide part 70 is already described with reference to the eighth embodiment, and thus, the descriptions will not be repeated herein for the sake of brevity.

Eleventh Embodiment

Figure 31:
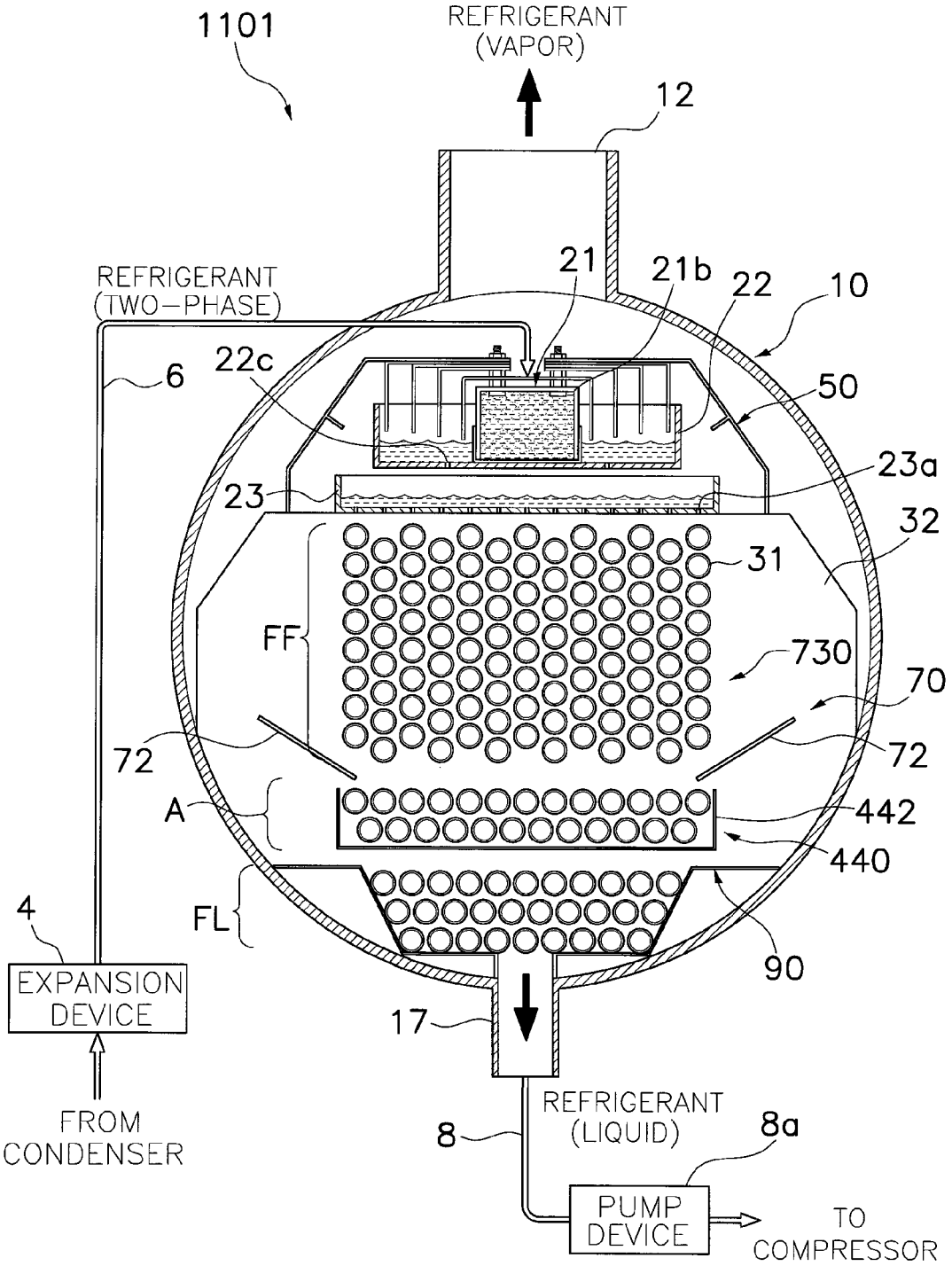
FIG. 31 is a simplified transverse cross sectional view of the heat exchanger illustrating an arrangement of a tube bundle, a trough part and a guide part according to an eleventh embodiment of the present invention.
Figure 32:
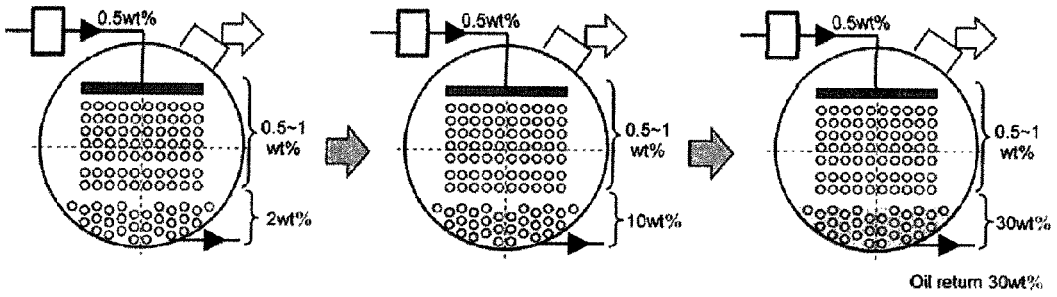
F I G. 32 (Prior Art)
FIG. 32 is a simplified cross-sectional view of a conventional hybrid (falling film and flooded) heat exchanger illustrating how the concentration of condensed refrigerant oil is increased.
Figure 33:
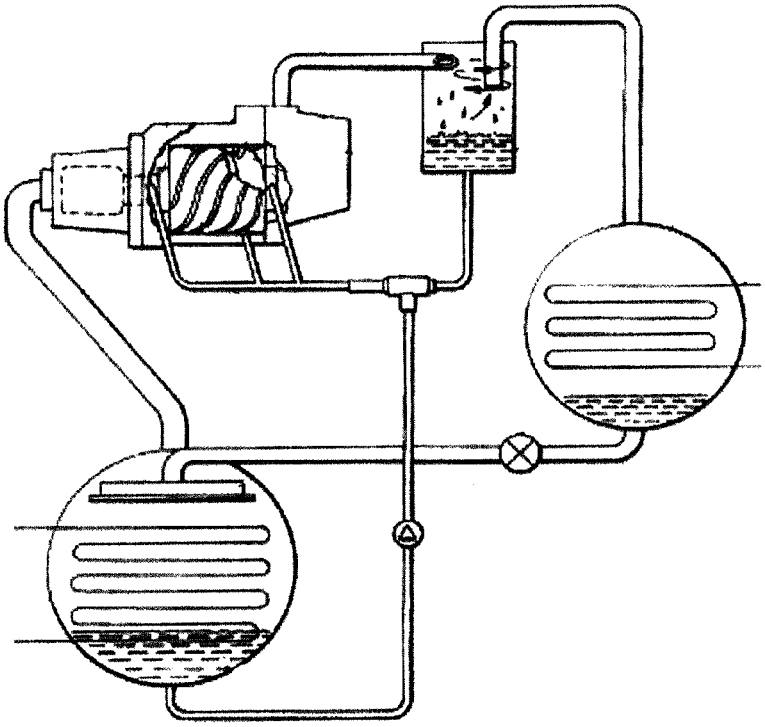
F I G. 33 (Prior Art)
FIG. 33 is a simplified circuit diagram of a conventional refrigerant cycle in which an oil tempering circuit is installed to return the oil to the compressor in this cycle.
Figure 34:
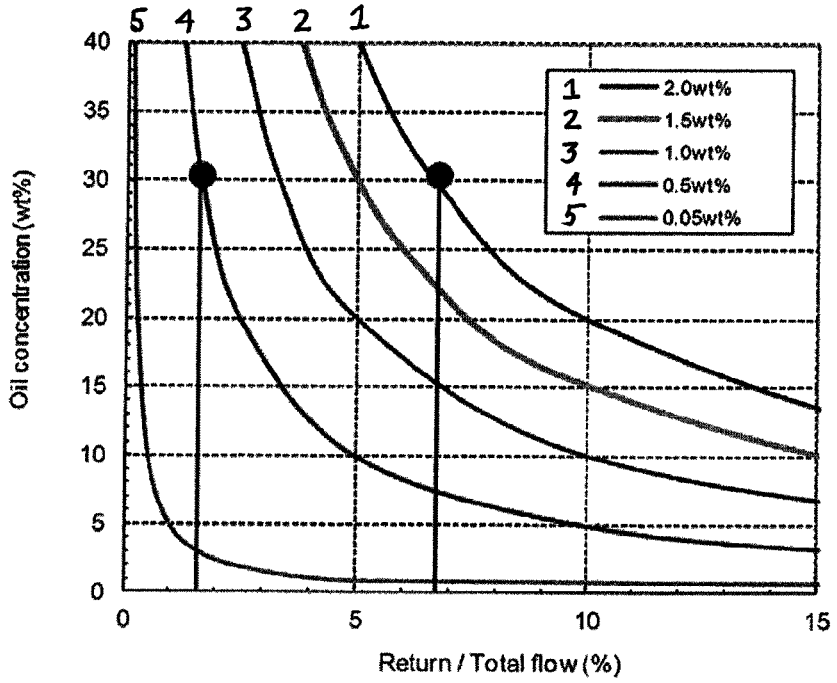
FIG. 34 is a graph illustrating oil concentration (wt %) on the Y axis and return/total Flow (%) on the X axis for a plurality of oil wt % refrigerant supplies.
Figure 35:
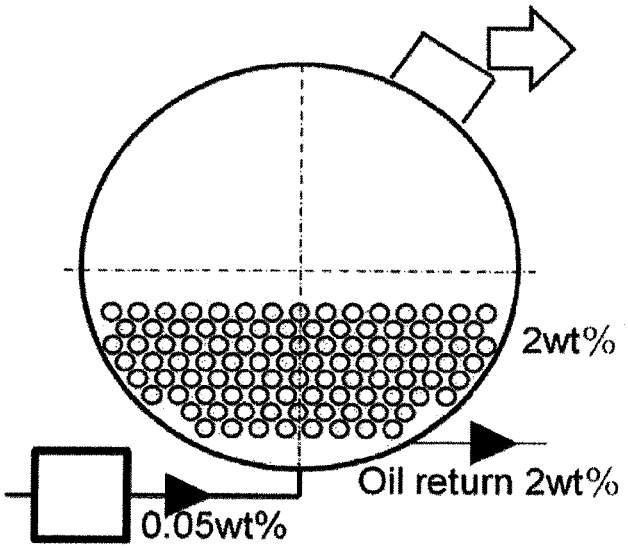
F I G. 35 (Prior Art)
FIG. 35 is a simplified cross-sectional view of a flooded-type evaporator with oil concentration percentages illustrated.
Figure 36:
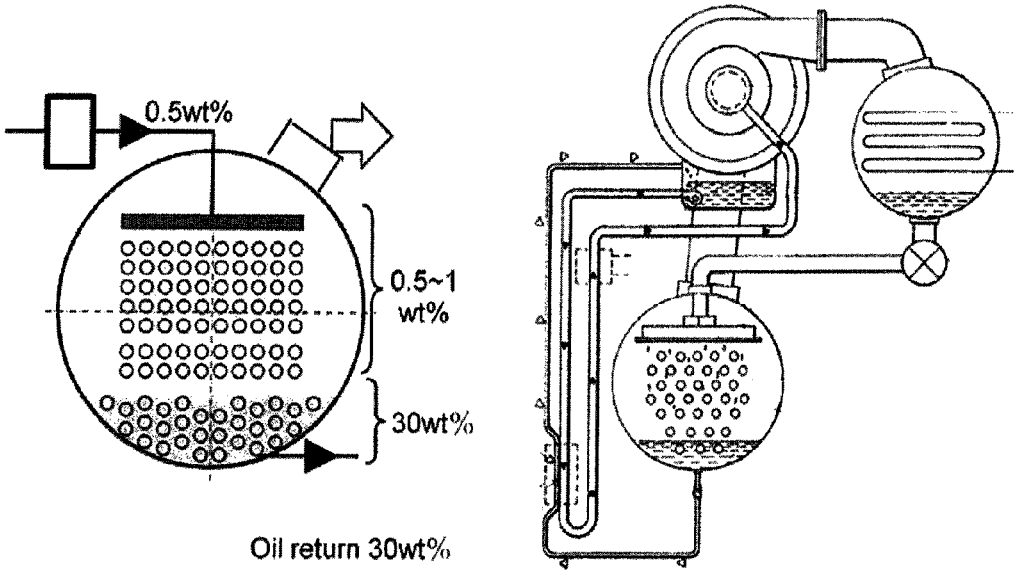
F I G. 36 (Prior Art)
FIG. 36 is a simplified cross-section al view of a conventional hybrid evaporator of a conventional refrigerant cycle with oil concentration percentages illustrated.
Figure 37:
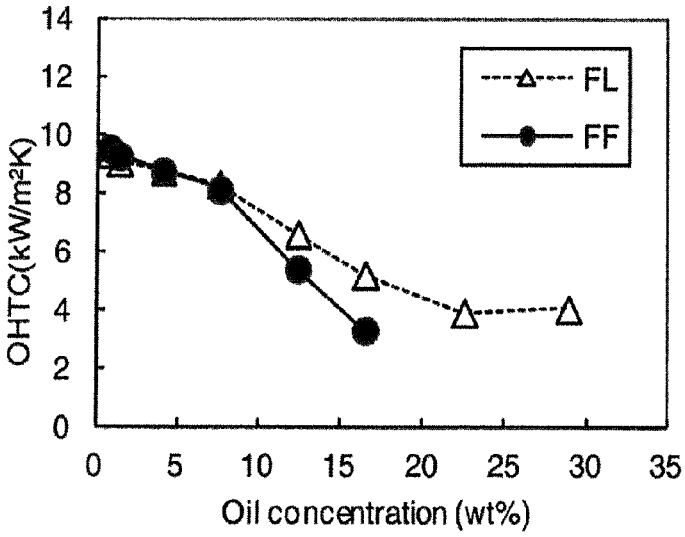
FIG. 37 is a graph illustrating heat transfer performance as OHTC ($kW/m^2K$) on the Y axis and Oil concentration (wt %) on the X axis for a flooded-type heat exchanger (FL) and a Falling Film type heat exchanger (FF).

Referring now to FIG. 31, an evaporator 1101 in accordance with a eleventh embodiment will now be explained. This eleventh embodiment is identical to the seventh embodiment, except this eleventh embodiment includes the guide part 70 (i.e., like the eighth embodiment). Therefore, the descriptions and illustrations of the seventh embodiment also apply to this eleventh embodiment, except as discussed and illustrated herein. In view of the similarity between the eleventh embodiment and the preceding embodiments, the parts of the eleventh embodiment that are identical to the parts of other embodiments will be given the same reference numerals as the parts of the other embodiments. Moreover, the descriptions of the parts of the eleventh embodiment that are identical to the parts of the other embodiments may be omitted for the sake of brevity.

The evaporator 1101 in accordance with this eleventh embodiment is identical to the evaporator 701 of the seventh embodiment, except the evaporator 1101 includes the guide part 70 (of the eighth embodiment). The guide part 70 is already described with reference to the eighth embodiment, and thus, the descriptions will not be repeated herein for the sake of brevity.

Advantages of Embodiments

Advantages to the structures disclosed in the above embodiments will now be explained. In a hybrid falling film type evaporator, a tray (i.e., in accumulating region A) is provided between a falling film type upper section and a flooded type lower section, and heat transfer pipes are provided there to gradually condense oil. Oil is eventually condensed in the flooded type lower section (FL). Oil is condensed gradually by this arrangement.

The refrigerant falling from the upper section (FF) is sometimes scattered toward the shell 10. If the scattered refrigerant falls down to the flooded section (FL), the refrigerant to be treated in the flooded section (FL) will be increased. In order to avoid this situation, a guide 70 can be provided to return the scattered refrigerant to the trough part 40 (i.e., in accumulating region A), and the refrigerant is treated in the trough part 40. Furthermore, condensation can be performed more efficiently by providing the guide 70.

With the disclosed embodiments, since the concentration of oil gradually changes as liquid flows downwardly, the heat transfer performance in the trough part 40 (i.e., in accumulating region A) other than the flooded type section is improved. Therefore, the number of heat transfer pipes can be reduced with the same capacity of heat exchange. Also, the amount of the refrigerant can be reduced by decreasing the size of the flooded region FL. The flooded section tray 90 and can even further reduce the size of the flooded region (FL), and thus further reduce the amount of refrigerant needed.

In the flooded region FL as with the conventional technique, oil is mixed in the final concentration of 30 wt %. However, with the disclosed embodiments, oil can be condensed more gradually by providing a trough part 40 between the falling film region FF and the flooded region FL. Therefore, the cases of low performance as happened in the conventional technique are reduced, and the total heat transfer performance will be improved.

In a typical flooded section, there can be many areas in which heat transfer pipes cannot be provided, and also a relatively larger amount of refrigerant is needed. However, such invalid areas can be reduced greatly and the amount of the refrigerant can be further reduced by providing flooded section tray 90 corresponding in size and shape to the pipes in the flooded region.

According to the conventional art, the flooded section is 25% or less in U.S. Pat. No. 5,561,987), and it is 25% or more and preferably around 50% in U.S. Pat. No. 5,839,294). There is no description in the claims of U.S. Patent Publication No. 2011/0017432, but it was around 33% when the product was disassembled and the inside was checked.

On the other hand, according to the present invention, the total heat exchange area of the accumulating region A and the flooded region FL is 30% or less than a total heat exchange area of the tube bundle 30. In other words, a sum of the number of heat transfer tubes 31 in the accumulating region A and the number of heat transfer tubes 31 in the flooded region FL is preferably 30% or less than a total number of the heat transfer tubes 31 in the tube bundle. In the illustrated embodiment, the heat transfer tubes 31 all have identical outer diameters, in which case the numbers of tubes correspond to the above ratio. However, if tubes have different sizes, the sum of the heat exchange area of the accumulating region A and the flooded region FL is 30% or less than a total heat exchange area of the tube bundle 30. The drawings of this application are simplified for the purpose of illustration. In other words, the exact number of tubes in the regions illustrated herein may not correspond to the ratios discussed in this paragraph in all the embodiments. However, it will be apparent to those skilled in the art from this disclosure that the simplified drawings are not intended to illustrate the exact ratios, but rather the general structure of the embodiments. In the illustrated embodiments, when 0.5 wt % oil concentration refrigerant is supplied to the evaporator 1, the above ratio is desirable.

However, regarding sections other than the falling film type sections, the required ratio will vary depending on the oil concentration. In a case where the concentration is as small as around 0.1 wt %: 25% or less (sufficient effects can be obtained in 15-25%) as described in U.S. Pat. No. 5,561,987. In a case where the concentration is around 0.5 wt %: the ratio can be around 30% or less as described in the preceding paragraph.

In a case where the concentration is around 0.5-1 wt %: the ratio can assumedly be around 30%-50%. In a case where the concentration is much higher, since the amount of liquid refrigerant carried away at the time of withdrawal becomes large, the system cannot work. In actual operation for the illustrated embodiments, oil concentration of around 0.5 wt % will preferably be used as mentioned above.

The ratio of the accumulating region A to the flooded region FL is preferably near 50:50. In any case, the ratio is preferably no less than 1:2 and no more than 2:1, but more preferably between 40:60 and 60:40, but even more preferably about 50:50. Thus, the oil concentration increases gradually in the accumulating region A, and the concentration finally increases to a predetermined concentration (e.g., 30 wt %) in the flooded region FL at the bottom.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. As used herein to describe the above embodiments, the following directional terms "upper", "lower", "above", "downward", "vertical", "horizontal", "below" and "transverse" as well as any other similar directional terms refer to those directions of an evaporator when a longitudinal center axis thereof is oriented substantially horizontally as shown in FIGS. 6 and 7. Accordingly, these terms, as utilized to describe the present invention should be interpreted relative to an evaporator as used in the normal operating position. Finally, terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A heat exchanger adapted to be used in a vapor compression system, the heat exchanger comprising:

a shell with a longitudinal center axis extending generally parallel to a horizontal plane, the shell having a liquid outlet opening with an outlet pipe extending outwardly therefrom;

a distributing part disposed inside of the shell, and configured and arranged to distribute a refrigerant;

a tube bundle including a plurality of heat transfer tubes disposed inside of the shell below the distributing part so that the refrigerant discharged from the distributing part is supplied onto the tube bundle, the heat transfer tubes extending generally parallel to the longitudinal center axis of the shell, the tube bundle including a falling film region disposed below the distributing part, an accumulating region disposed below the falling film region, the accumulating region including one or two tiers of heat transfer tubes, and a flooded region disposed below the accumulating region at a bottom portion of the shell, the flooded region having a fluid communication tube portion extending upwardly from an internal surface of the shell at the liquid outlet opening to a bottom of the flooded region, the fluid communication tube portion having a tube opening abutting the shell, and the fluid communication tube portion being aligned with the outlet pipe; and a trough part extending generally parallel to the longitudinal center axis of the shell under at least one of the heat transfer tubes in the accumulating region to accumulate the refrigerant therein, the trough part at least partially overlapping with the at least one of the heat transfer tubes in the accumulating region when viewed along a horizontal direction perpendicular to the longitudinal center axis of the shell.

2. The heat exchanger according to claim 1, further comprising a guide part including at least one lateral side portion extending upwardly and laterally outwardly from the tube bundle at a vertical position at an upper end of the trough part.

3. The heat exchanger according to claim 2, wherein the lateral side portion of the guide part includes an inclined section inclined between 10 degrees and 45 degrees relative to a horizontal plane passing through the longitudinal center axis.

4. The heat exchanger according to claim 2, wherein the trough part includes a pair of outermost lateral ends disposed further from a vertical plane passing through the longitudinal center axis than the heat transfer tubes of the tube bundle, and the guide part includes a pair of lateral side portions extending upwardly and laterally outwardly from the outermost lateral ends of the trough part.

5. The heat exchanger according to claim 4, wherein the lateral side portions of the guide part laterally overlap the outermost lateral ends of the trough part, as viewed along the longitudinal center axis.

6. The heat exchanger according to claim 4, wherein each lateral side portion of the guide part includes an inclined section inclined between 10 degrees and 45 degrees relative to a horizontal plane passing through the longitudinal center axis.

7. The heat exchanger according to claim 1, wherein the heat transfer tubes in the accumulating region are arranged in a horizontal row when viewed along the longitudinal center axis of the shell.

8. The heat exchanger according to claim 7, wherein the trough part includes a single trough section continuously disposed below the horizontal row of the heat transfer tubes in the accumulating region as viewed along the longitudinal center axis.

9. The heat exchanger according to claim 7, wherein the trough part includes a plurality of laterally arranged trough sections disposed below the horizontal row of the heat transfer tubes in the accumulating region as viewed along the longitudinal center axis.

10. The heat exchanger according to claim 9, wherein each trough section includes a bottom wall portion and a pair of side wall portions, two of the side wall portions form the outermost lateral ends of the trough part and a remaining number of the side wall portions form inner side wall portions, and the inner side wall portions have vertical heights smaller than the two of the side wall portions forming the outermost lateral ends of the trough part.

11. The heat exchanger according to claim 10, wherein the inner side wall portions extend vertically upward from the bottom wall portions to positions overlapping at least 50% of the heat transfer tubes in the horizontal row.

12. The heat exchanger according to claim 1, wherein the heat transfer tubes in the accumulating region are arranged in at least two horizontal rows when viewed along the longitudinal center axis of the shell.

13. The heat exchanger according to claim 7, wherein the trough part includes a plurality of trough sections disposed below the horizontal rows in a number of tiers corresponding to a number of the horizontal rows of the heat transfer tubes in the accumulating region as viewed along the longitudinal center axis.

14. The heat exchanger according to claim 1, wherein the heat transfer tubes in the accumulating region are arranged in two horizontal rows when viewed along the longitudinal center axis of the shell, and the trough part includes a single trough section continuously disposed laterally under the heat transfer tubes disposed in the accumulating region.

15. The heat exchanger according to claim 1, wherein a sum of a number of the heat transfer tubes in the accumulating region and a number of heat transfer tubes in the flooded region is 30% or less than a total number of heat transfer tubes in the tube bundle.

16. The heat exchanger according to claim 1, wherein the trough part is located immediately above the flooded region.

17. A heat exchanger adapted to be used in a vapor compression system, the heat exchanger comprising:

a shell with a longitudinal center axis extending generally parallel to a horizontal plane;

a distributing part disposed inside of the shell, and configured and arranged to distribute a refrigerant;

a tube bundle including a plurality of heat transfer tubes disposed inside of the shell below the distributing part so that the refrigerant discharged from the distributing part is supplied onto the tube bundle, the heat transfer tubes extending generally parallel to the longitudinal center axis of the shell, the tube bundle including a falling film region disposed below the distributing part, an accumulating region disposed below the falling film region, the heat transfer tubes in the accumulating region being arranged in at least two horizontal rows when viewed along the longitudinal center axis of the shell, and a flooded region disposed below the accumulating region at a bottom portion of the shell; and a trough part extending generally parallel to the longitudinal center axis of the shell under at least one of the heat transfer tubes in the accumulating region to accumulate the refrigerant therein, the trough part at least partially overlapping with the at least one of the heat transfer tubes in the accumulating region when viewed along a horizontal direction perpendicular to the longitudinal center axis of the shell, the trough part including a plurality of trough sections disposed below the horizontal rows in a number of tiers corresponding to a number of the horizontal rows of the heat transfer tubes in the accumulating region as viewed along the longitudinal center axis, each tier including a plurality of the trough sections, each trough section including a bottom wall portion and a pair of side wall portions, two of the side wall portions of the trough sections in each tier forming outermost lateral ends of the tier and a remaining number of the side wall portions forming inner side wall portions of the tier, and any inner side wall portions of each tier having vertical heights smaller than the two of the side wall portions forming the outermost lateral ends of the tier.

18. The heat exchanger according to claim 17, wherein the inner side wall portions of each tier extend vertically upward from the bottom wall portions to positions overlapping at least 50% of the heat transfer tubes in the horizontal row above the tier.

19. A heat exchanger adapted to be used in a vapor compression system, the heat exchanger comprising:

a shell with a longitudinal center axis extending generally parallel to a horizontal plane;

a distributing part disposed inside of the shell, and configured and arranged to distribute a refrigerant;

a tube bundle including a plurality of heat transfer tubes disposed inside of the shell below the distributing part so that the refrigerant discharged from the distributing part is supplied onto the tube bundle, the heat transfer tubes extending generally parallel to the longitudinal center axis of the shell, the tube bundle including a falling film region disposed below the distributing part, an accumulating region disposed below the falling film region, and a flooded region disposed below the accumulating region at a bottom portion of the shell with heat transfer tubes in the flooded region being submerged in refrigerant;

a trough part extending generally parallel to the longitudinal center axis of the shell under at least one of the heat transfer tubes in the accumulating region to accumulate the refrigerant therein, the trough part at least partially overlapping with the at least one of the heat transfer tubes in the accumulating region when viewed along a horizontal direction perpendicular to the longitudinal center axis of the shell; and a flooded region tray disposed under the heat transfer tubes disposed in the flooded region below the accumulating region, the flooded region tray having a fluid communication tube portion aligned with an outlet pipe of the shell, the flooded region tray vertically overlapping the heat transfer tubes in the flooded region as viewed along the horizontal direction such that flooded region tray is not completely below the heat transfer tubes in the flooded region.

20. The heat exchanger according to claim 19, wherein the flooded region tray has a size and shape corresponding to an overall size and shape of the heat transfer tubes of the flooded region below the accumulating region.

21. The heat exchanger according to claim 19, wherein the trough part is located immediately above the flooded region.

* * * * *